US011365606B2

(12) United States Patent
Andreychuk et al.

(10) Patent No.: US 11,365,606 B2
(45) **Date of Patent: *Jun. 21, 2022**

(54) DOWNHOLE SLEEVE ASSEMBLY AND SLEEVE ACTUATOR THEREFOR

(71) Applicant: KOBOLD CORPORATION, Calgary (CA)

(72) Inventors: Mark Andreychuk, Calgary (CA); Per Angman, Calgary (CA); Allan Petrella, Calgary (CA); David Christopher Parks, Calgary (CA)

(73) Assignee: KOBOLD CORPORATION, Calgary (CA)

( * ) Notice: Subject to any disclaimer, the term of this patent is extended or adjusted under 35 U.S.C. 154(b) by 224 days.

This patent is subject to a terminal disclaimer.

(21) Appl. No.: 16/586,248

(22) Filed: Sep. 27, 2019

(65) Prior Publication Data

US 2020/0040703 A1 Feb. 6, 2020

Related U.S. Application Data

(63) Continuation of application No. 15/143,368, filed on Apr. 29, 2016, now Pat. No. 10,472,928.

(60) Provisional application No. 62/155,365, filed on Apr. 30, 2015.

(51) Int. Cl.
*E21B 34/14* (2006.01)
*E21B 23/00* (2006.01)

(52) U.S. Cl.
CPC ..... *E21B 34/14* (2013.01); *E21B 23/006* (2013.01); *E21B 2200/06* (2020.05)

(58) Field of Classification Search
CPC ..... E21B 34/14; E21B 34/12; E21B 23/006; E21B 2034/007; E21B 33/12; E21B 33/1294; E21B 21/103; E21B 34/142; E21B 2200/06; E21B 33/00; E21B 21/10–106
See application file for complete search history.

(56) References Cited

U.S. PATENT DOCUMENTS 4,105,069 A * 8/1978 Baker ..... E21B 23/006 166/289
2013/0092398 A1* 4/2013 McCoy ..... E21B 23/00 166/382

* cited by examiner

*Primary Examiner* — George S Gray
(74) *Attorney, Agent, or Firm* — Parlee McLaws LLP

(57) ABSTRACT

A bottom hole actuator tool for locating and actuating one or more sleeve valves spaced along a completion string. A shifting tool includes radially extending dogs at ends of radially controllable, and circumferentially spaced support arms. Conveyance tubing actuated shifting of an activation mandrel, indexed by a J-Slot, cams the arms radially inward to overcome the biasing for in and out of hole movement, and for releasing the arms for sleeve locating and sleeve profile engagement. A cone, movable with the mandrel engages the dogs for positive locking of the dogs in the profile for sleeve opening and closing. A treatment isolation packer can be actuated with cone engagement. The positive engagement and compact axial components results in short sleeve valves.

11 Claims, 27 Drawing Sheets

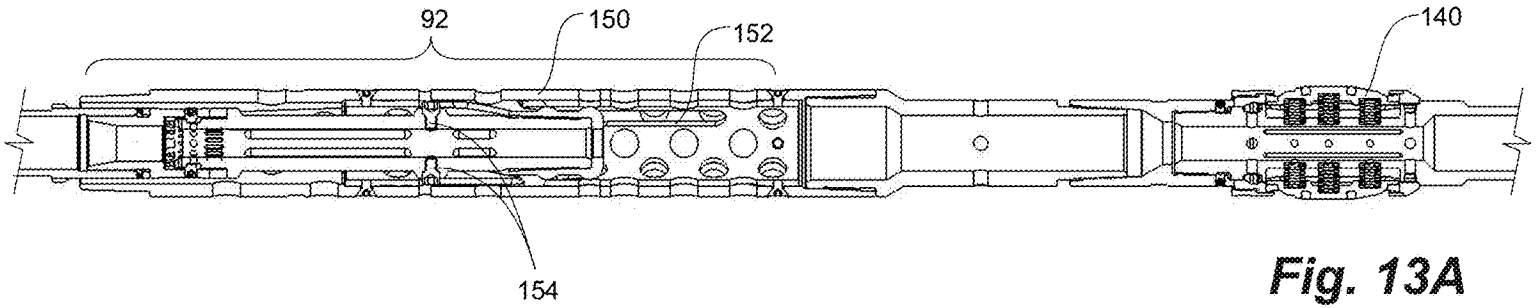
Fig. 13A
Fig. 13B
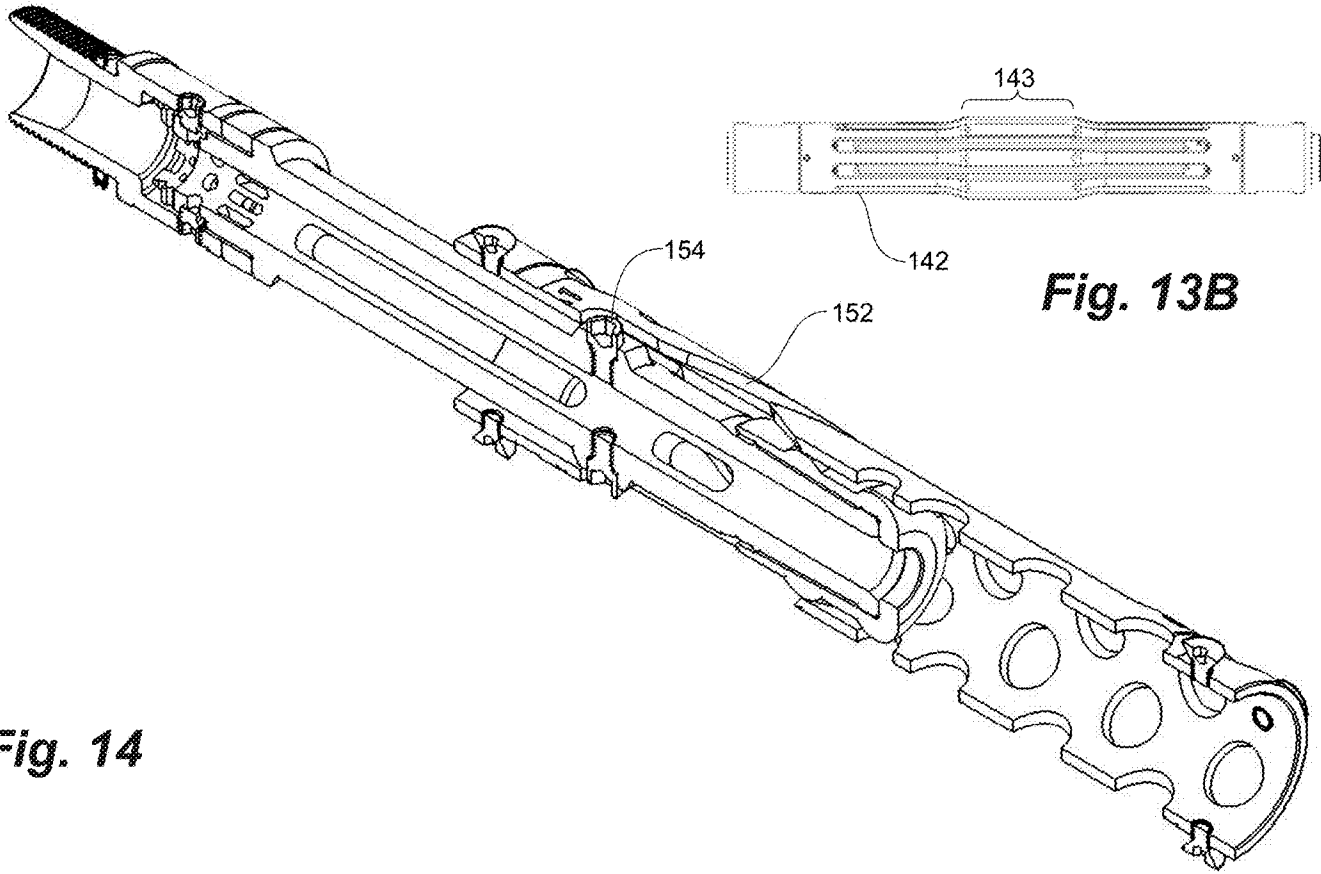
Fig. 14

DOWNHOLE SLEEVE ASSEMBLY AND SLEEVE ACTUATOR THEREFOR

FIELD

Embodiments herein relate to apparatus and methods for completion of a wellbore and, more particularly, to apparatus and methods for completing a wellbore and fracturing a formation therethrough.

BACKGROUND

It is well known to line wellbores with a completion string, liners or casing and the like and, thereafter, to create flowpaths through the casing to permit fluids, such as fracturing fluids, to reach the formation therebeyond.

One such conventional method for creating flowpaths is to perforate the casing using apparatus such as a perforating gun, which typically utilize an explosive charge to create localized openings through the casing.

Alternatively, the casing can include pre-machined ports, located at intervals therealong. The ports are typically sealed during insertion of the casing into the wellbore, such as by a dissolvable plug, a burst port assembly, a sleeve or the like. Optionally, the casing can thereafter be cemented into the wellbore, the cement being placed in an annulus between the wellbore and the casing. Thereafter, the ports are typically selectively opened by removing the sealing means to permit fluids, such as fracturing fluids, to reach the formation.

Typically, when sleeves are used to seal the ports, the sleeves are releasably retained over the ports, also known as sleeve valves, and can be actuated to slide within the casing to open and close the respective ports. Many different types of sleeves and apparatus to actuate the sleeves are known in the industry. Fluids are directed into the formation through the open ports. At least one sealing means, such as a packer, is employed to isolate the balance of the wellbore below the sleeve from the treatment fluids.

A variety of tools are known for actuating sleeves in ported subs including the use of shifting tools, profiled tools and packers. In U.S. Pat. No. 6,024,173 to Patel and assigned to Schlumberger, a shifting tool and a position locator is disclosed for locating a downhole device and engaging a packer element within moveable member and operating the device using and applied axial force to shift the member.

In Canadian Patents 2,738,907 and 2,693,676, both to NCS Oilfield Services Canada Inc., a bottom hole assembly (BHA) is deployed at an end of coiled tubing and located adjacent a ported sub by a sleeve locator. The BHA has a sealing member and an anchor such as a releasable bridge plug or well packer, which are set inside the ported sub fit for shifting a sliding sleeve and opening ports to the wellbore. From an uphole end, the BHA is connected to coiled tubing, has a fluid cutting assembly (jet cutting tool), a check valve for actuating the jet cutting tool, a bypass/equalization valve and the sealing member, the releasable anchor and the sleeve locator. A multifunction valve, including reverse circulation and pressure equalization, is positioned between the abrasive fluid jetting assembly and the sealing element. Set down on the coiled tubing closes the multifunction valve, blocking fluid communication to the tubing below the sealing member, and aligning ports in the valve for reverse circulation between the annulus and one way flow up the coiled tubing through the check valve. Pull up on the coiled tubing opens the multifunction valve to permit flow through a port in the valve between the annulus and the tubing the below the sealing member for equalization and though the port in the valve between the annulus and one way flow up the coiled tubing for reverse circulation. The check valve prevents fluid delivered through the coiled tubing from moving beyond the jetting assembly. Thus, fluid delivered through the coiled tubing is only used to cut perforations. Treatment fluid, such as for fracturing, is delivered through the annulus, between the BHA and the casing, to the ports opened by the sleeve.

The sleeve locator, at an intermediate position along locates a bottom of a closed sleeve, fit within a sleeve housing intermediate the BHA. The sealing member and anchor are uphole of the locator and are intended to set within the sleeve. Locating is performed with an uphole action. Actuation of the anchor and sealing member are performed with a downhole action. The length of the sleeve, increasing length of which contributing to an increasing manufacturing cost, is determined by the need to incorporate the length of the locator, the anchor and the sealing member, and accommodate some axial tolerance to successful arrest the anchor in the sleeve. Once the anchor successfully engages the sleeve to arrest its downhole movement and the sealing member expands, fluid pressure thereabove is applied to impart sufficient hydraulic force to actuate the sleeve downhole, typically initially at a force sufficient to release shear screws.

Incorporation of the sealing member, the releasable anchor and the sleeve locator, all of which must be cooperatively locatable within the sleeve housing, requires sleeve housing of significant length and related expense. Further, without additional components, the releaseable anchoring system is generally limited to downhole actuation of the sleeve.

There is interest in the industry for robust apparatus and methods of performing completion operations which are relatively simple, reliable, that could also provide uphole sleeve actuation on demand and which reduce the overall costs involved.

SUMMARY

A bottom hole assembly (BHA) or actuator tool is provided for use in cooperation with one or more sleeve valves spaced along a completion string or casing. Each sleeve valve comprises a sleeve housing spaced along the casing, each sleeve housing fit with a sleeve that is axially movable therein to open and close treatment ports formed in the sleeve housing. Sleeve valves are deemed consumables. In other words, the sleeve and sleeve housings are run in hole and remain there for the life of the well. There is an interest in minimizing the cost of such consumables.

As disclosed herein, the present actuator tool is short in length and both locates a sleeve and embodies an element that engages intermediate the sleeve for sleeve release, opening and closing. As a result, the corresponding sleeve housing can be short in length, and less expensive to manufacture. The sleeve valve need not have a separate downhole locator portion within the housing, nor incorporate a separate pup therebelow to facilitate locating. Instead, both locating and sleeve actuation is performed using a profile intermediate the sleeve and which enables bi-directional controlled actuation, such as to selectively open and close ports in the sleeve housing.

The sleeve can be unitary, and in an even more economical form, be a multi-component sleeve, assembled from multiple axially shorter and less expensive tubular components. Each sleeve is fit with an annular recess or profile.

Further, by forming the profile in a sleeve collar connected between uphole and downhole sleeve tubulars, the profile can be radially deeper, aiding in positive engagement, confirmation of engagement and actuation.

The profile can have an axial engagement length readily distinguishable from any sleeve's uphole and downhole end gaps and tool connections in the casing string. End gaps exist as result of differentials in the axial sleeve-to-housing lengths to accommodate axial shifting, from sleeve housing connections and collar locations.

The sleeve profile is engageable with radially extending dogs on the tool, the dogs being fit at ends of radially controllable levers or arms manipulated radially for selectable operation. The arms and supported dogs can be outwardly biased and the radial position of which can also be forcibly manipulated, overriding the biasing. Forcible manipulation includes radially inward restraint for running the tool in and out of hole, and for radially outward restraint to lock the dogs radially once engaged in the sleeve profile, and a biased radial outward configuration for location purposes. The manipulation of the dogs is achieved using up and downhole movement of a shifting mandrel, an arm restraining ring and a cam on the arm supporting the dogs. Up and downhole movement of the shifting mandrel is controlled by up and downhole weight on the conveying tubing. The axial position of the shifting mandrel is controlled by a J-Slot mechanism. The shifting mandrel is connected to the conveyance tubing and extends though the tool. The J-Slot mechanism can be located downhole of the dogs and thus has no bearing on sleeve length.

As above, axial alignment of the shifting mandrel relative to the cams on the dog arms selectively restrains the dog's radial position for enabling sleeve engagement and disengagement. In the embodiment shown, the J-Slot mechanism applies four distinct positions to positively engage the sleeve profile for both uphole and downhole operation, yet also be releasable for longitudinal or axial movement to the next sleeve housing.

The dog and sleeve profile combination is also suitable for implementing sleeve release without need for hydraulic-assisted actuation with sleeve release achieved with an uphole overpull, or downhole setdown, or a jar device actuated by uphole or downhole weight. To mitigate any downhole setdown challenges in extended length horizontal wells, the sleeve profile can also be used for positive sleeve engagement on an uphole run, with controlled uphole shifting overpull or uphole jar actuation being applied when the dog is confirmed engaged with the sleeve, such as to overcome shear screws.

A sealing element or packer is still provided for isolation downhole of the tool for well treatment thereabove, including the application of fracturing fluids to the formation.

A new economy and flexibility in treatment methodology is now possible with short sleeve valves, assured sleeve locating and selectable opening and closing of some or all sleeves.

Further, in embodiments, one can perform fracturing from toe-to-heel, opening sleeves and treating zone-after-zone while pulling out of hole (POOH) and in other embodiments one can perform fracturing heel-to-toe by opening, treating and closing sleeves one-by-one while running downhole.

Further, where it is desirous to permit a fractured zone to rest or heal for several hours after treatment, a toe-to-heel operation has advantages in one can open a sleeve, treat, close and move uphole to open and treat and close a sleeve at the next zone and so on. After all zones are treated, the actuator tool can be run back downhole, typically a couple of hours later or other such optimal delay in many cases, and begin to open each or various sleeves coming back out of hole. Thus the earliest and downhole-most stages can have up to ½ a day or, even days, before they are finally opened.

As the locating and sleeve engagement is positive, the one tool movement and sleeve engagement is all that is necessary to reliably locate, open or close the sleeve.

In an embodiment, J-slot tool manipulation reliably shifts the tool between:

An intermediate downhole position, for run-in-hole (RIH), with the dogs restrained radially inward got tool movable downhole of a sleeve of interest;

An extreme uphole position, for releasing the dogs to be biased radially outward while running uphole sleeve profile location;

An extreme downhole set position for restraining the dogs radially outward into the profile for shifting the sleeve downhole to open the sleeve valve and enable fluid treatment therethrough;

An extreme uphole position once again for either cycling the J-slot or, with overpull weight control, to optionally close the sleeve post fluid treatment, An intermediate uphole position, for releasing the dogs from the sleeve profile and cycling the J-slot;

An intermediate position downhole position for again restraining the dogs radially inward to enable tool movement downhole of a sleeve of interest;

Completion of the J-slot for repeating the cycle again for the next sleeve valve and repeat the sequence.

In one broad aspect, a system of downhole sleeves and actuation thereof comprises a completion string having a plurality of sleeve valves therealong, each sleeve valve having a sleeve housing and an axially shiftable sleeve, each sleeve having an annular profile formed intermediate the sleeve; and a shifting tool having an activation mandrel connected to a J-Slot mechanism having a J-Pin operable in a J-Slot housing and a drag block for restraining the housing, one or more dogs movable axially along the activation mandrel and radially actuable between a radially outward biased position, a sleeve profile-engaged position, and a radially inward collapsed position, a cone movable axially along the activation mandrel between two positions, an engaged position with the dogs to lock them in the profile-engaged position and disengaged position, and a packer for sealing to the sleeve, the packer sealing to the sleeve in the cone's engaged position, wherein the axial length of the sleeve valve is about the axial length of the packer, cone and dogs.

In one embodiment, the J-slot mechanism suitable for optional sleeve closing after treatment comprises a J-slot profile having: a first intermediate downhole position to shift the dogs to the radially inward collapsed position without engaging the cone with the dogs, a first extreme uphole position to shift the dogs to the radially outward biased position and profile engaging position when so located; an extreme downhole position to open the sleeve and move the cone to the engaged position for treatment; a second extreme uphole position with the dogs remaining in the profile-engaging position; a second intermediate downhole position to shift the dogs to the radially inward collapsed position for releasing the tool from the sleeve; and an intermediate uphole position to shift the dogs to the radially inward collapsed position for pulling out of hole; and a return to the first intermediate downhole position to restart the sequence. In another embodiment, the J-slot profile is absent the second extreme uphole position and the second intermediate downhole position, for moving directly to the intermediate uphole position for pulling out of hole.

In another embodiment, a shifting tool for sleeve valves comprises an activation mandrel connected to a J-Slot mechanism having a J-Pin operable in the J-Slot profile of a J-slot housing and a drag block for restraining the J-slot housing; one or more dogs supported on one or more pivotable arms, the arms and dogs supported about and movable axially along the activation mandrel, each dog being radially actuable between a radially outward biased position, a sleeve profile-engaged position, and a radially inward collapsed position; springs for biasing each dog radially outwardly from the activation mandrel; and a retainer ring movable axially along the activation mandrel for actuating the one or more arms the between the radially outward biased position and the radially inward collapsed position.

BRIEF DESCRIPTION OF THE DRAWINGS

FIGS. 1A through 10A are cross-sectional views of an actuator tool accessing a casing string illustrating one sleeve and sleeve housing according to embodiments described herein. The actuator tool's conveying tubing, downhole J-slot, drag blocks toe sub, if any, are omitted. FIGS. 1B through 10B are close-up views of the cross-sectional views of sleeve and sleeve housing according to corresponding FIGS. 1A through 10A. The "A" and corresponding "B" figures are illustrated on the same sheet;

FIGS. 1A and 1B illustrate the tool as it is run-in-hole through the sleeve housing;

FIGS. 5A and 5B illustrate the tool set in casing between sleeve housings, wherein FIG. 5B is extended uphole to illustrate the casing above the sleeve housing;

FIGS. 10A and 10B illustrate the tool in pull out of hole (POOH) mode and moving uphole to another sleeve and sleeve housing;

FIG. 13A is a cross-section view of a downhole end of the actuator tool including a J-slot mechanism and a drag block;

FIG. 13B is a side view of an alternate drag block for the actuator tool according to FIG. 13A;

FIG. 14 is a perspective view of the J-Slot mechanism of FIG. 13A, the structure of the J-slot housing removed to better illustrate the configurable J-slot profile sleeve and opposing J-pin shifting mandrel;

FIGS. 17A through 17F, respectively, are related to operations for running in hole (M2 RIH), uphole locating (U LOC), downhole shifting (D, SHFT), uphole sleeve closing (U CLS/CYC), releasing (M2 RLS), and pulling out of hole (M1 POOH) steps as dictated and corresponding to the J-Slot pattern of FIG. 16A;

DESCRIPTION OF THE PREFERRED EMBODIMENTS

General Overview

Figure 1A:
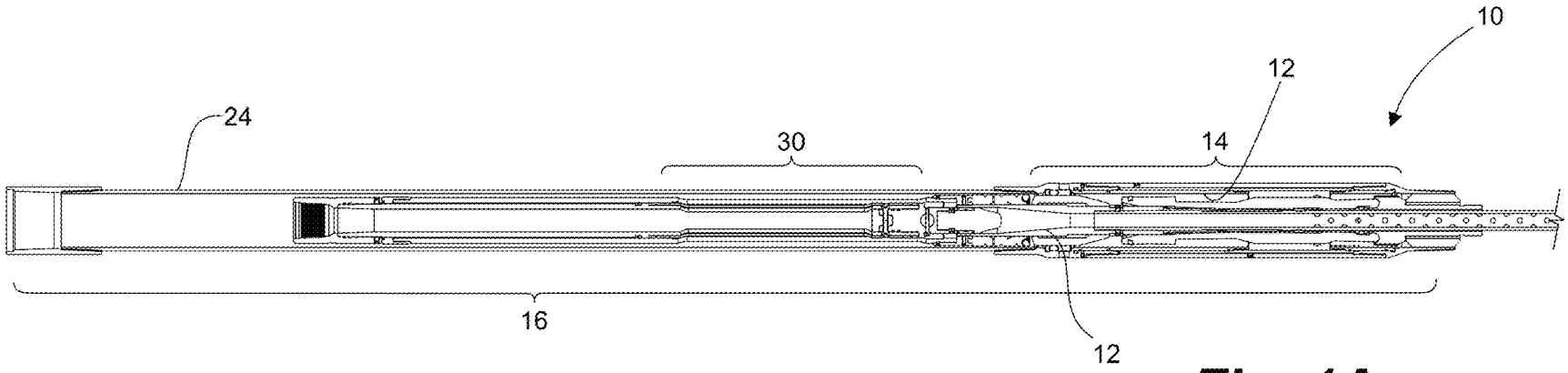

In embodiments, tubing conveyed system 10 is provided comprising a treatment tool 12 that is used to manipulate a large number of sleeve valves 14 (cemented or uncemented) along a completion string 16 in an oil or gas well (vertical, deviated or horizontal) by opening or closing the sleeves 20 therein at any time for various reasons without tripping the tool 12 from the wellbore. The tool can be conveyed on coiled or jointed tubing. Herein the tool is described as being conveyed on coil tubing and hence, a "coil tool".

Selectively Open And Close Sleeves

Embodiments of the treatment tool 12 are operable to open the sleeve 20 before the frac to provide access to the reservoir, while isolating the rest of the well. An operator can close the sleeve after the frac treatment if desired to isolate the newly stimulated zone to: prevent cross flow to previous stimulated stages, and to allow the frac to "heal", minimizing sand flow back into the well on production. Opening and closing of sleeves can be done in any sequence, heel to toe, toe to heel or any sequence of stages thereof. As introduced above, a sleeve valve 14 comprises a sleeve housing 22 having a bore fit with a sleeve 20, the sleeve being axially movable to open and close ports in the sleeve housing. Depending on the context, sleeve valves may be generally referred to herein as sleeves.

Closing Problem Zones

Embodiments of the treatment tool are operable to close selected sleeves during the life of the well to control unwanted production from a particular stage or stages (e.g. water production in a water flood situation). Water flood development plays typically include wells that are injectors and producers. Water flow through the reservoir can be determined by several industry existing methods, e.g. production logging, radioactive/chemical tracers etc. Once the location of water flow is determined one can then decide to close sleeves to minimize water production and maximize oil production.

Programmed Sleeve Opening

Embodiments of the treatment tool are operable to drill and complete a having many sleeves installed and only sections of them being opened and stimulated at one time. This maximizes production and drawdown of the hydrocarbons along the length of the well, particularly in long deviated or horizontal wells.

Full Bore Sleeves

Embodiments of the treatment tool are operable to provide sleeves having full bore access to the well after treatment. Unlike prior art ball-drop type apparatus, the current tool avoid flow restriction for effective post-treatment production or for remedial work over access to the well.

Controllable Stimulation

Embodiments of the treatment tool are operable to pinpoint stimulation-type treatment, such as for fracturing, acid injection and the like, with sleeves in a more controllable "placement" of the stimulation versus limited entry such as "plug and perf" or open hole systems such as open hole packers with ball drop activated sleeves.

Treatment Tool

With reference to FIG. 1A the treatment tool is configured for run-in-hole RIH mode for free movement through sleeves 20 and casing 24.

The primary design drivers for this assembly are primarily; to simplify the tool, increase functionality of the tool, provide well flow control capability and reduce the cost of the consumable component, in this case the sleeve valves.

Figure 3A:
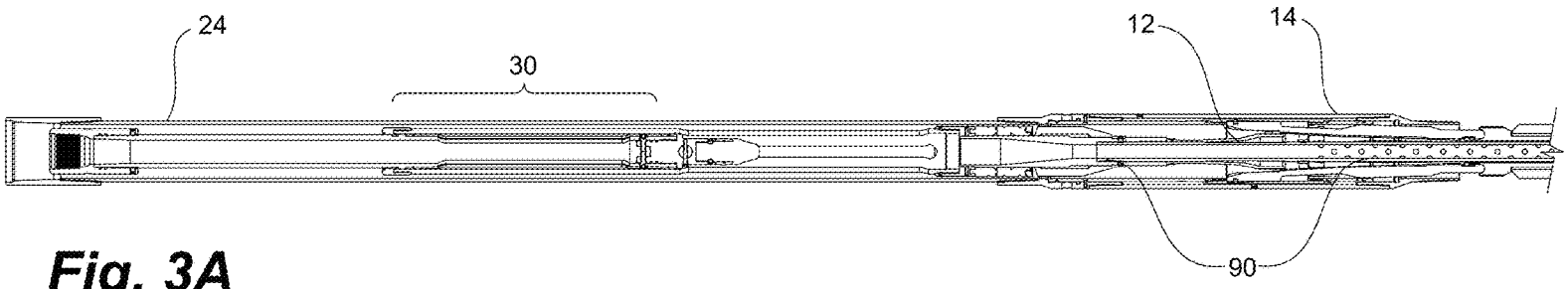
FIGS. 3A, 3B and 3C illustrate the tool as it is pulled up with the tool's dogs in locate mode and having engaged a sleeve of interest, FIGS. 3B and 3C being enlarged views of the arm and selector valve portions of the tool respectively.
Figure 3C:
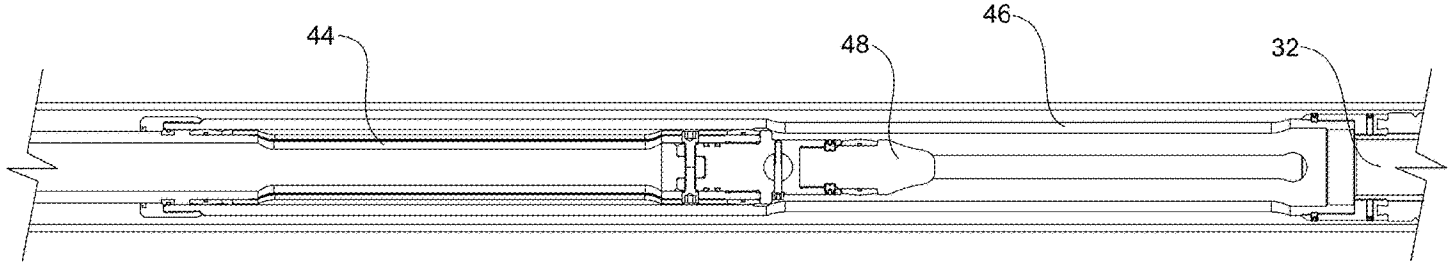
Figure 3B:
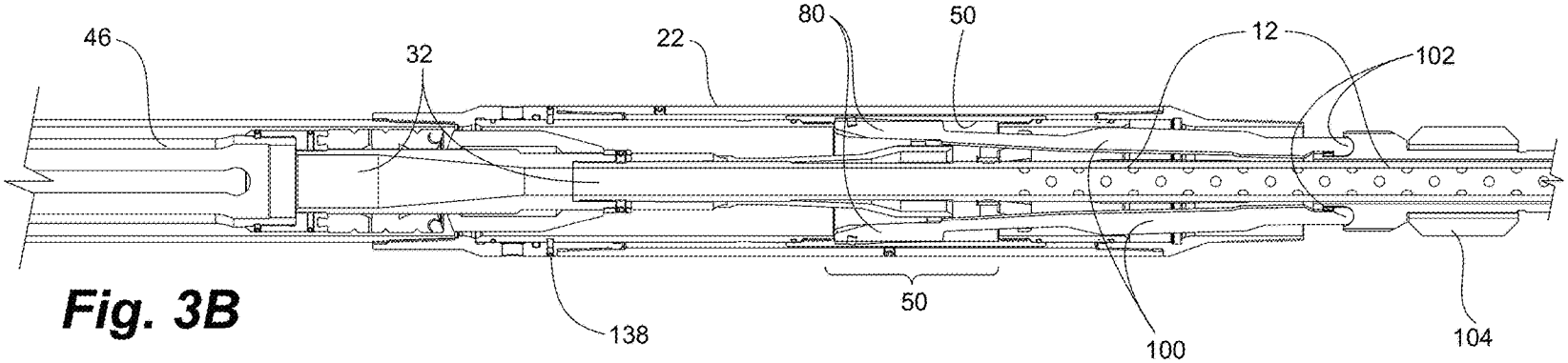
Figure 4A:
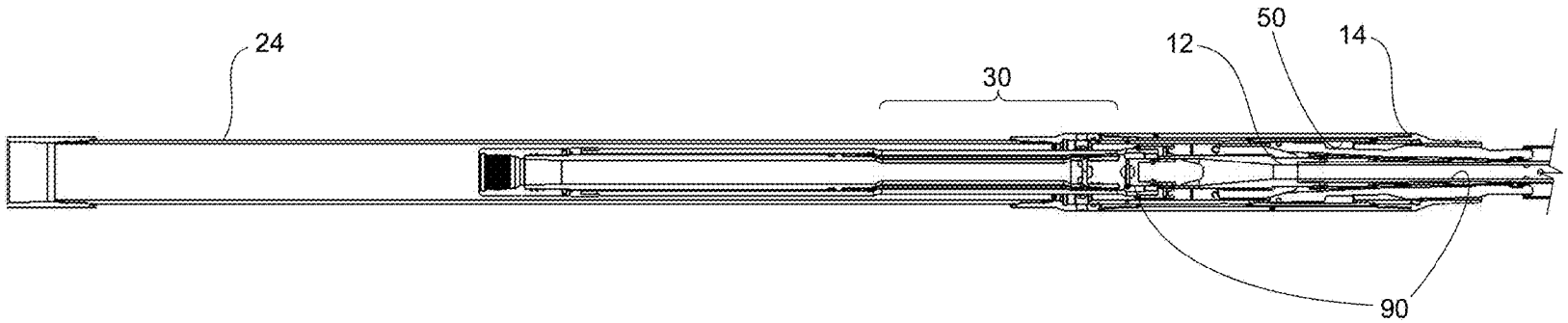
FIGS. 4A and 4B illustrate the tool set in the sleeve and shifted open, ready for treatment such as hydraulic fracturing.
Figure 4B:
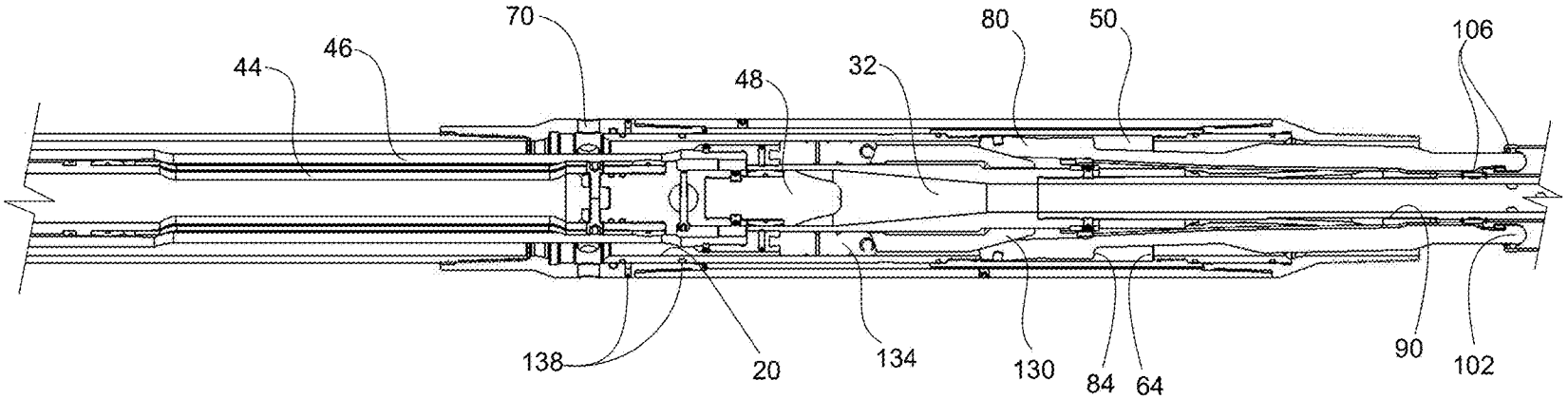

Including sleeve engagement components, the tool design contains a selector valve 30 for controlling flow to and through the tool 12. The selector valve enables flow to the formation while blocking flow past the tool, and alternately for enabling flow though the tool bore 32 such as during repositioning. The selector valve 30, as shown in embodiments herein, can include telescoping tubulars with aligning wall ports 44, 46 (FIGS. 4A,4B) and misaligned wall ports 44, 46 (FIGS. 3A and 3C) and a plug or bypass valve 48 for opening and closing the tool bore 32. The form of selector valve 30 may be available in various configurations and is not required for the manipulation of sleeve capability of the shifting tool 12.

Figure 11A:
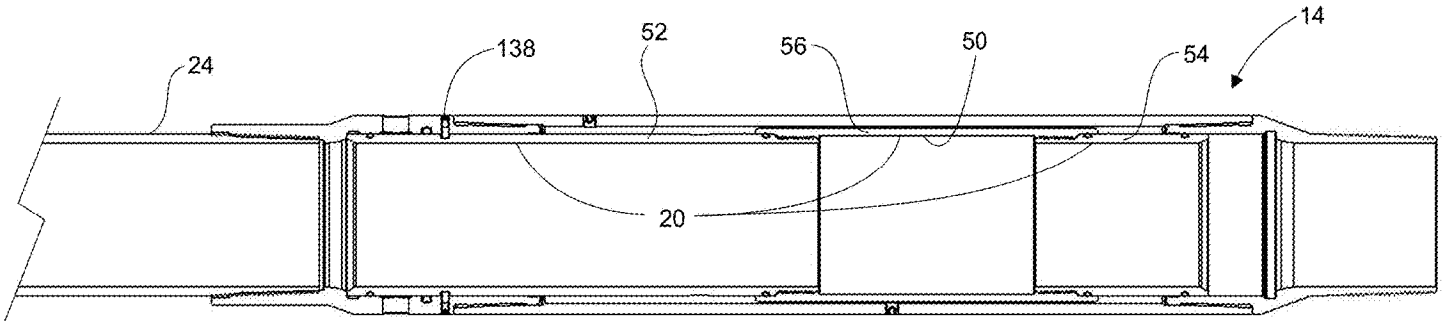
FIGS. 11A and 11B illustrate an embodiment of the sleeve housing and sleeve in the closed and open positions respectively, the sleeve housing configured for a sleeve shift downhole to open.
Figure 11B:
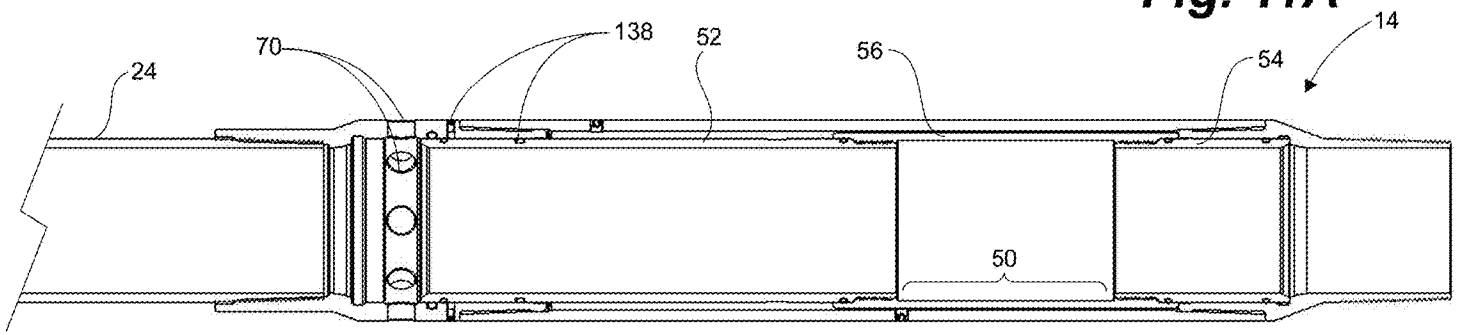

With reference to FIGS. 11A and 11B, a downhole-opening sleeve valve 14 can comprise a tubular sleeve housing 22 fit with a tubular sleeve 20. The sleeve 20 can be a unitary sleeve having an annular recess or profile 50 formed intermediate along its length. Alternatively, the sleeve can be formed of multiple, axially connectable tubulars. As shown, uphole and downhole end tubulars 52, 54 are connected by a larger diameter, union tubular 56. The uphole termination 64 of the downhole end tubular, and the downhole termination 62 of the uphole end tubular forms the profile 50 therebetween. In this embodiment, the sleeve 20 is shiftable downhole for opening ports 70 uphole of the uphole end tubular.

The sleeve profile 50 is intermediate the sleeve's length. The profile 50 is annular can has generally right angle uphole and downhole interfaces 62, 64. The tool's dog 80 also has generally right angle uphole 82 and downhole interfaces 84. As discussed herein, the tool is manipulated to be restrained radially inwardly for RIH and POOH operations and need not use chamfered edges for movement within the completion string 16.

The tool's dog 80 and compatible sleeve profile 50 component eliminates the need for an independent location device such as a collar or sleeve end locator. An uphole shoulder 82 of the dog 80 is used to locate the upper shoulder 62 of the sleeve profile 50 for location purposes and for optional release, shifting uphole for re-closing or both. There is no need to compromise the locator function with prior device that is a compromise between locating sleeve ends or casing collars as is performed in conventional tools.

With reference to FIGS. 3A, 3B, 3C, 13A, 17A and 18A, the tool 12 further comprises an axially manipulated activation mandrel 90 extending slidably through bore of the tool and being connected downhole to an axially indexing J-slot mechanism 92. The actuation portion of the tool comprise radially actuable arms supporting the profile-engaging dogs, radial arm biasing strings, an axially movable retaining ring for arm mode shifting and a dog locking cone.

The activation mandrel 90 is connected to the conveyance string (not shown) for axial manipulation therewith. The mandrel 90 can be tubular for selectable fluid communication therethrough: blocked when performing treatment operations and open when moving the tool 12.

Figure 17A:
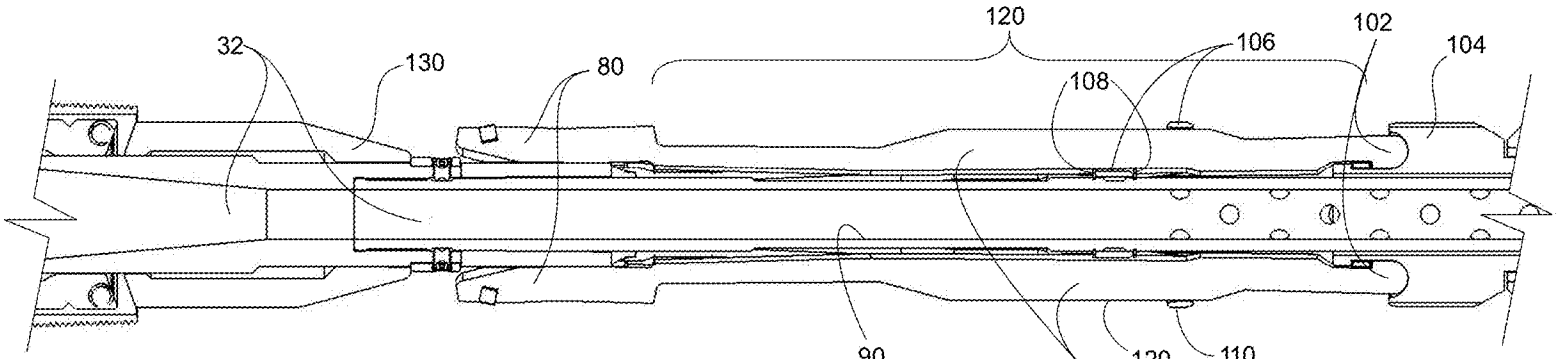
FIGS. 17A through 17F illustrate an embodiment of the dog actuating portion of the tool in isolation from the casing and sleeve for better detailing the components therein.
Figure 18A:
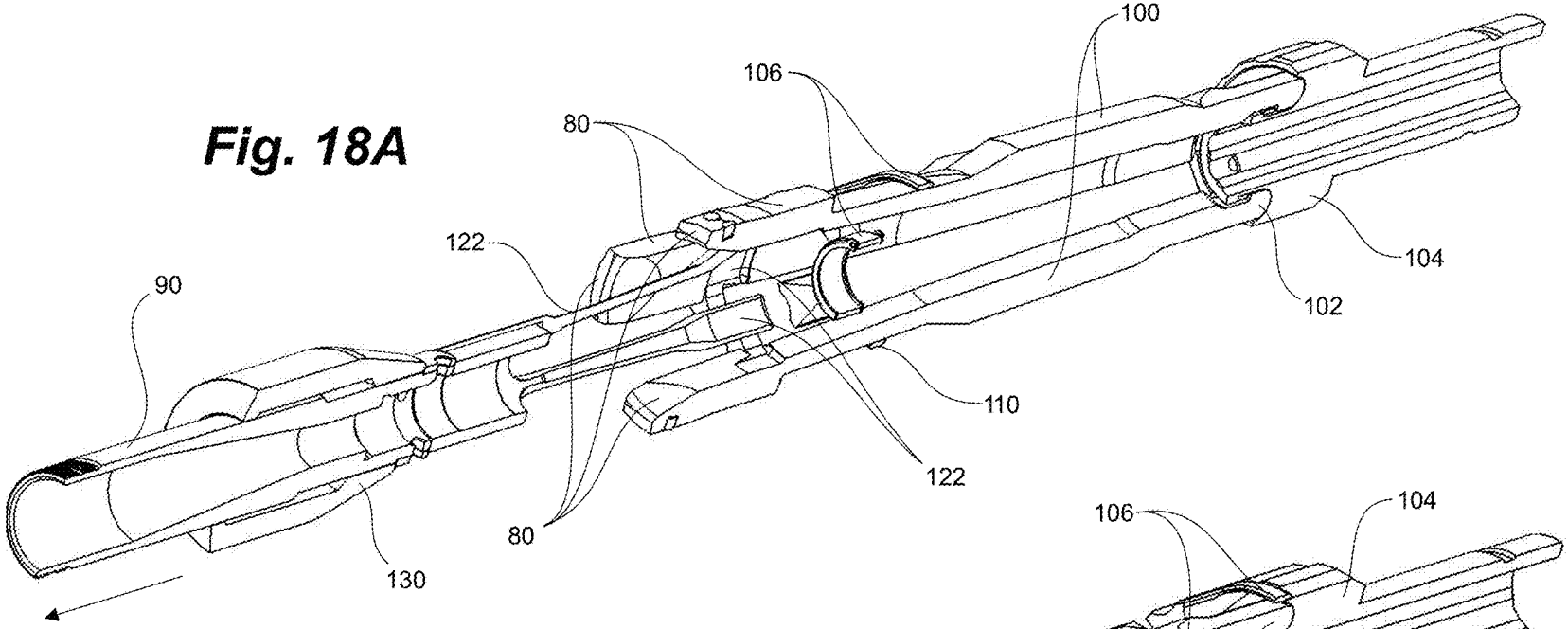
FIGS. 18A through 18D are perspective, cross-sectional views of the activation mandrel, arms supporting the dogs and the restraining ring portion of the tool for the biased locator mode, the set mode, the pull-out-of-hole, and the run-in-hole mode respectively.
Figure 18B:
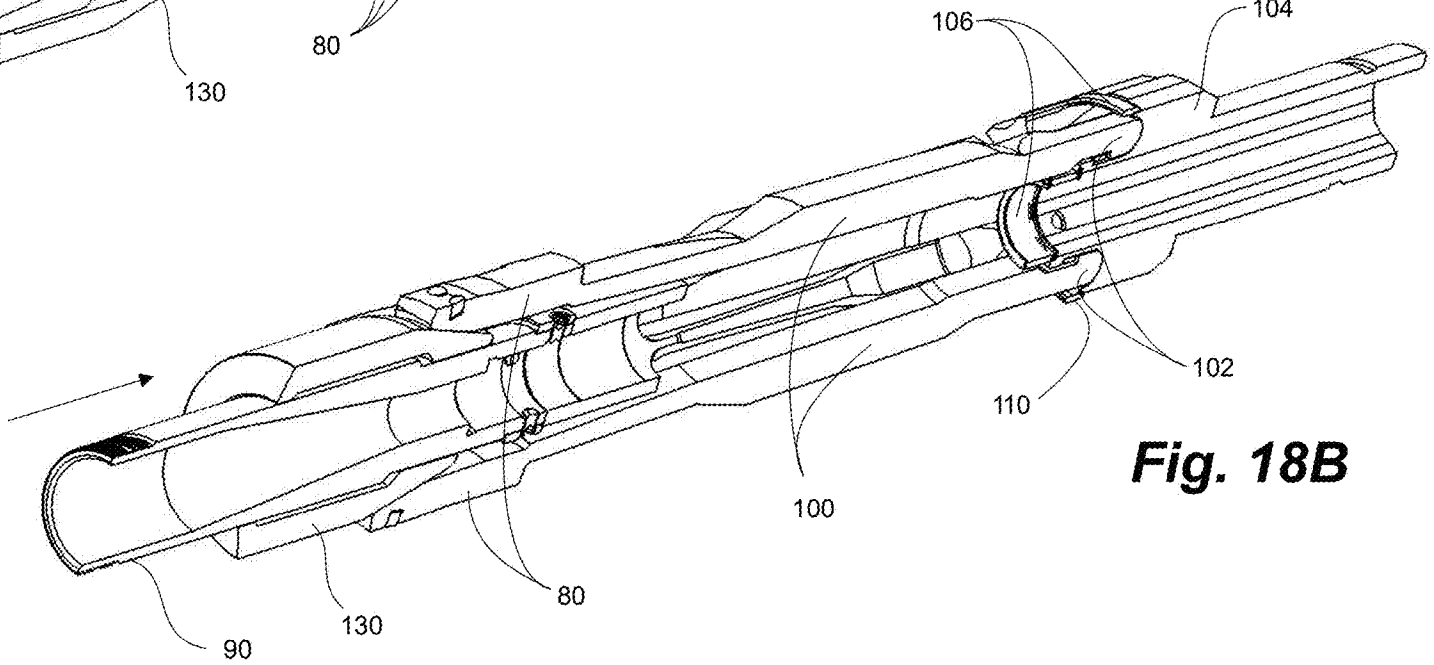
Figure 18C:
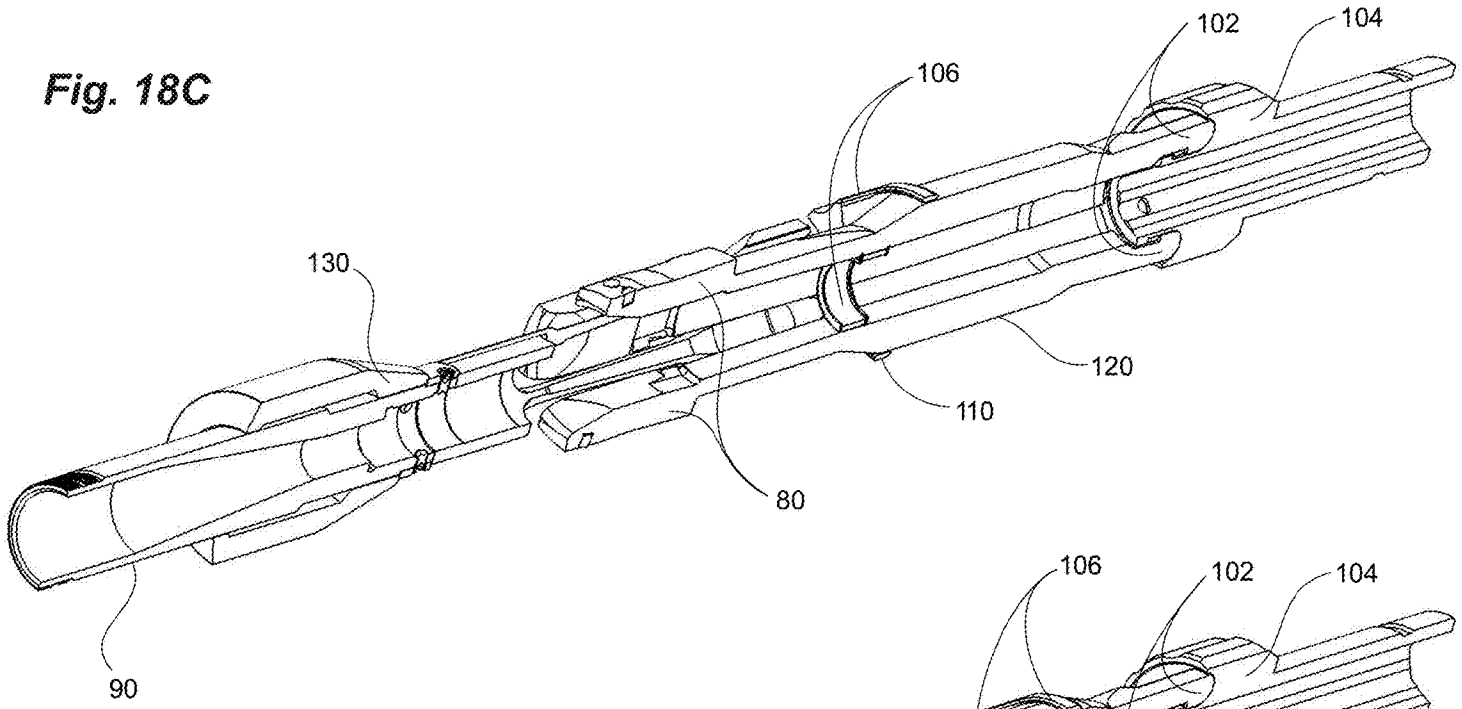
Figure 18D:
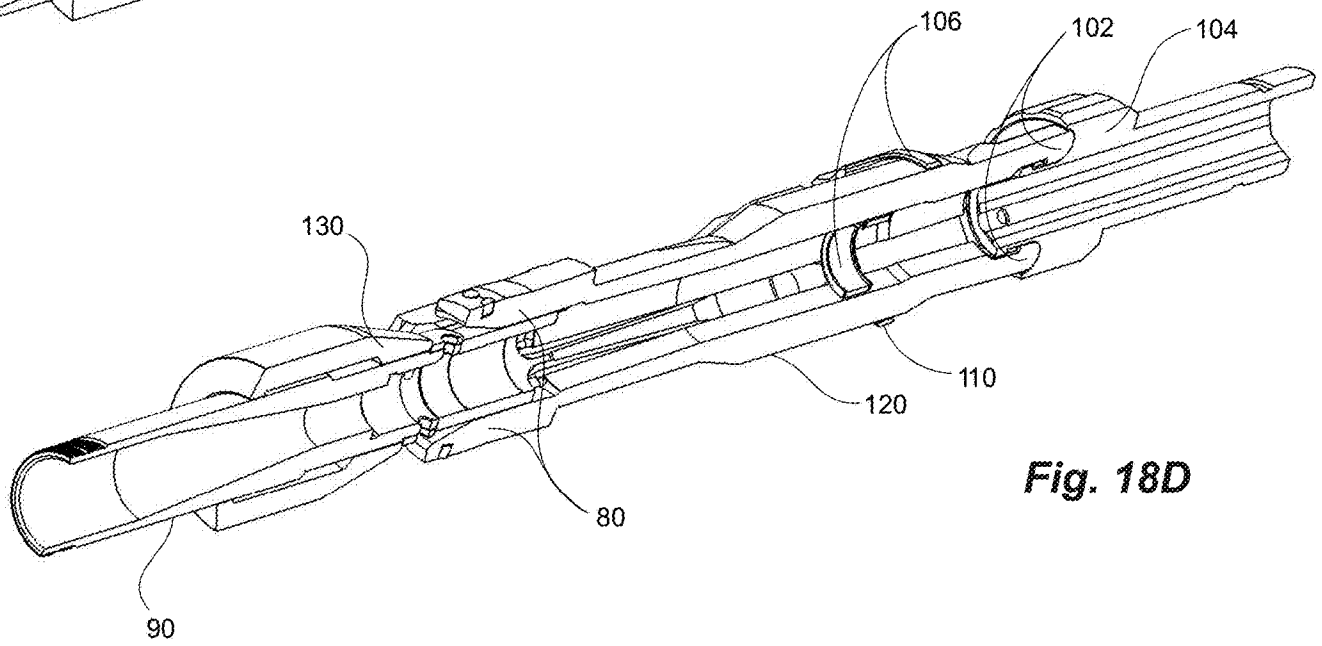
Figure 19A:
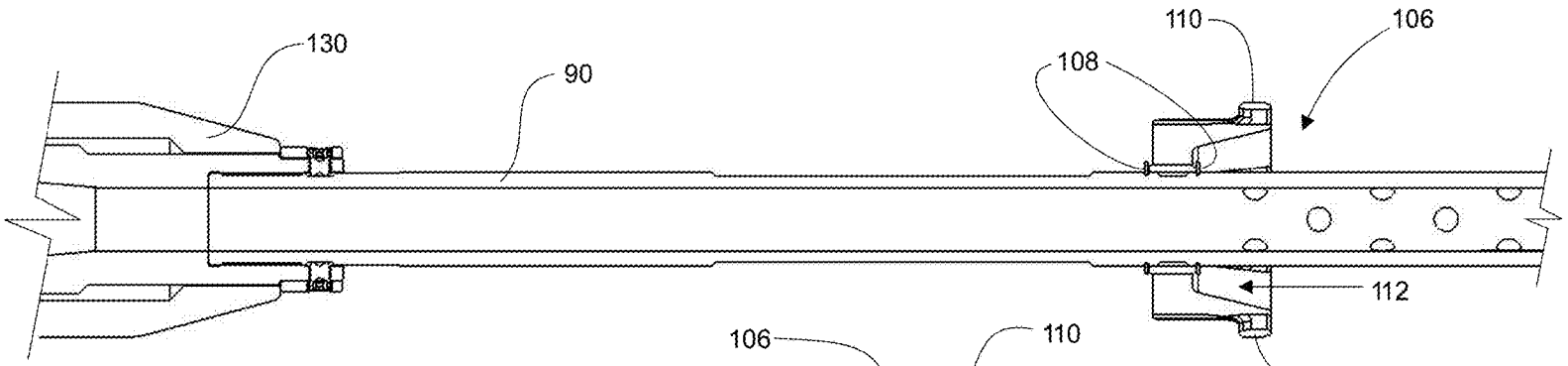
FIGS. 19A and 19B are side and perspective, cross-sectional views respectively of the activation mandrel fit with the restraining ring portion.
Figure 19B:
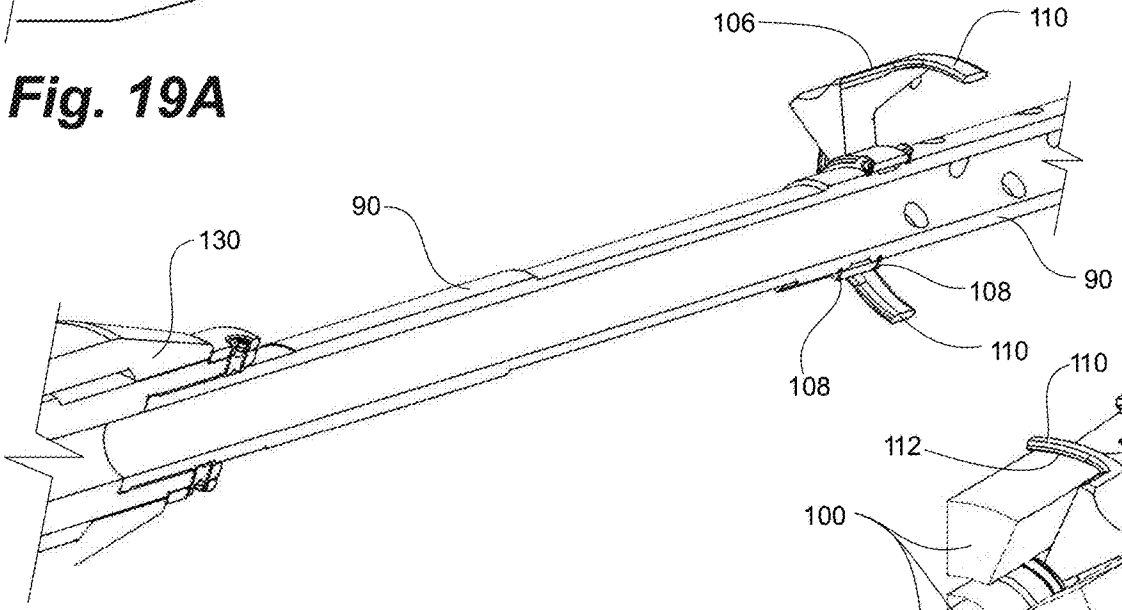
Figure 19C:
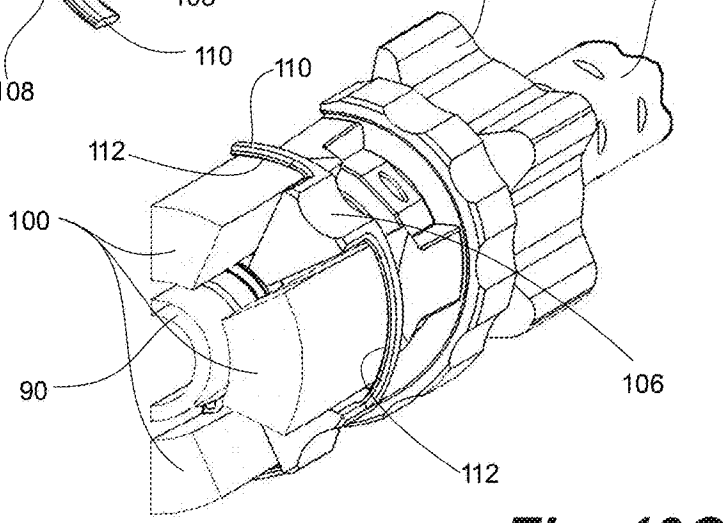
FIG. 19C is a perspective, cross-sectional view of a portion of the activation mandrel illustrating the restraining ring holding the arms close to the activation mandrel.

Best seen in FIGS. 17A and 18A, about the tool bore 32, and slidable about the activation mandrel 90, are three or more circumferentially spaced, and generally axially extending arms 100 bearing dogs 80 at one end thereof. The arms 100 are circumferentially spaced about the activation mandrel 90, each pivoted at a ball and socket connection 102 at an arm retainer 104 adjacent at one end (herein the downhole end), with the dogs 80 located at the other end (the uphole end). An arm retaining ring 106 is axially fixed to and therefore driven uphole and downhole by respective movement of the activation mandrel. The retaining ring 106 can be fit and locked to the activation mandrel 90 with snap rings 108, 108. As shown in FIGS. 19A, 19B and 19C, the retaining ring 106 has an annular ring portion 110, forming an arm annulus through which the arms 100 pass axially. The annular ring 110 and arm annulus 112 may or may not be circumferentially continuous, dictated by manufacturing and assembly purposes.

Figure 17B:
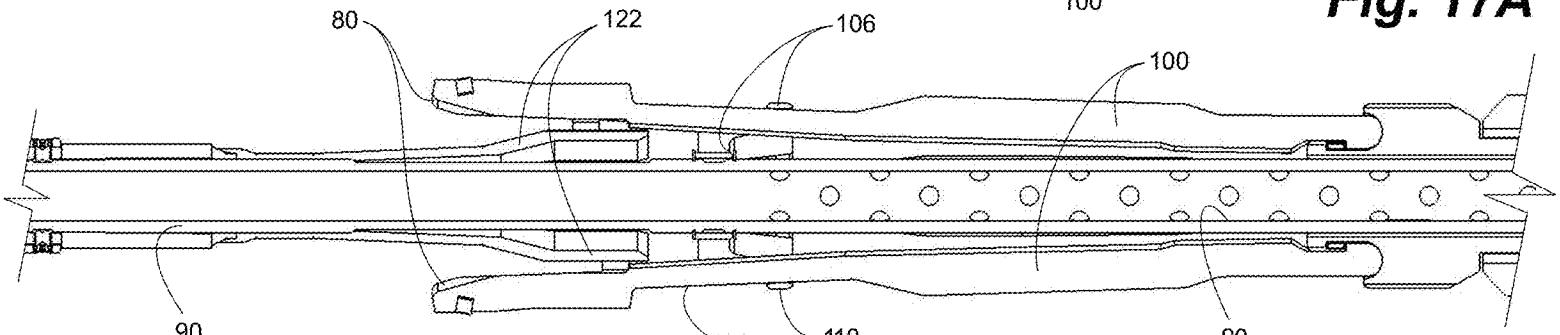
Figure 17C:
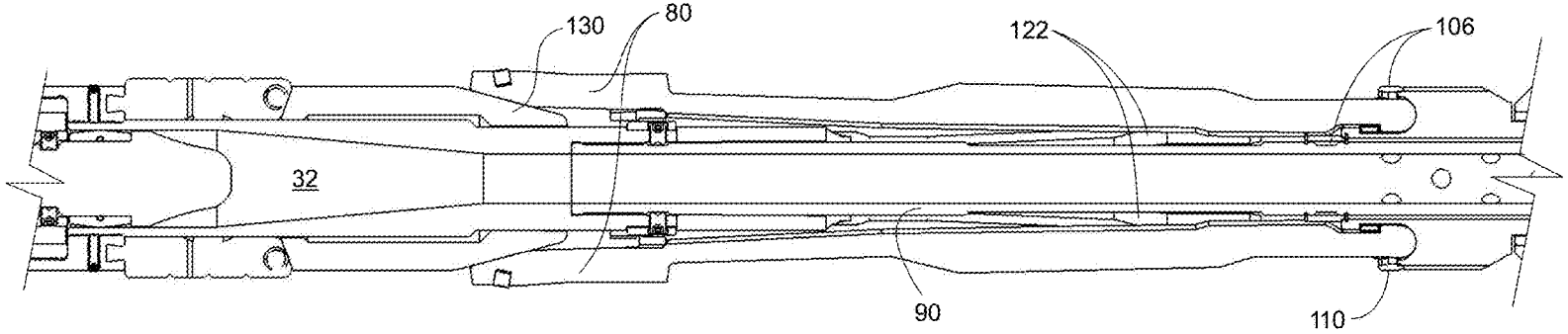

Returning to FIG. 17A, each arm 100 has an upstanding or radial height that varies along its axial length, forming a cam 120. For shifting modes of the dogs, the annular ring 110 is movable axially along the arms 100 and thus along the arm cam 120, driven by the axial indexing of the activation mandrel 90. Indexed axially, the annular ring 110 alternately engages a radially upstanding portion or depressed portion of the arm cam 120 to forcibly drive the arms radially inward (FIG. 17A) or release the arms to move radially outward (FIG. 17B) respectively. When released radially outward, springs 122 bias the arms 100 outwardly to resiliently drag along the completion string 16 and sleeve valve bores such as to axially locate the sleeve profile 50. When the sleeve 20 is located, further axial shifting of the activation mandrel 90 axially engages a wedge or cone 130 radially under the dogs 80, forcibly driving the dogs outward and locking them into the profile 50 for positive sleeve manipulation.

Alternatively, the arms can be fit with longitudinally extending grooves or tracks to form the cam and the retainer ring can support tangential pins to guide the track and arms as discussed.

The downhole or lower shoulder 84 of each dog 80 is used to engage a downhole or lower shoulder 64 of the sleeve profile 50 to enable setdown to shift the sleeve down 20 and open the ports 70. This can be reversed as well. An uphole or upper shoulder 82 of the dog can also be used to engage the uphole or upper shoulder 62 of the sleeve profile 50 to close the sleeve 20.

Figure 4C:
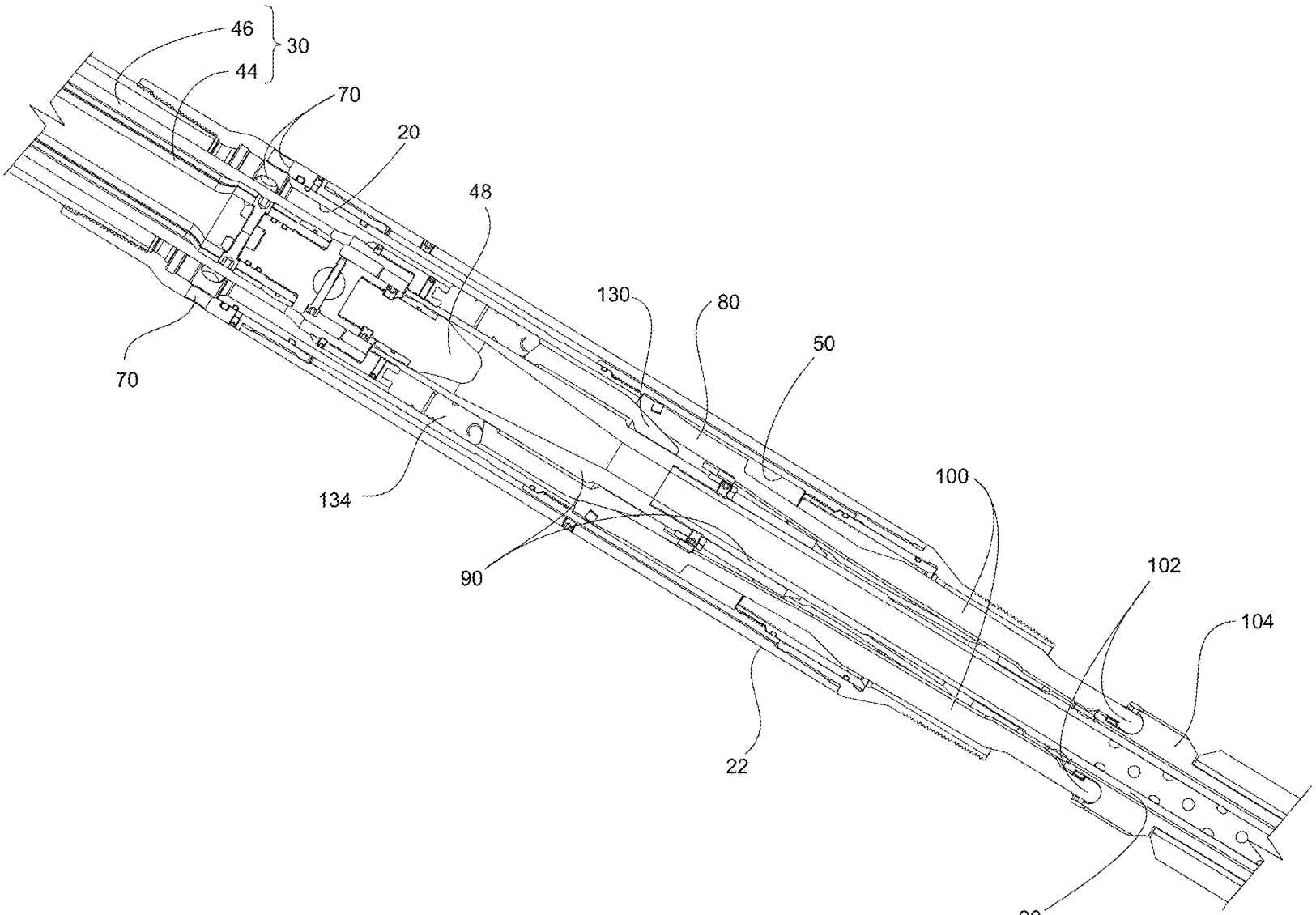
FIG. 4C is a larger view of the sleeve valve and tool of FIG. 4B.
Figure 17D:
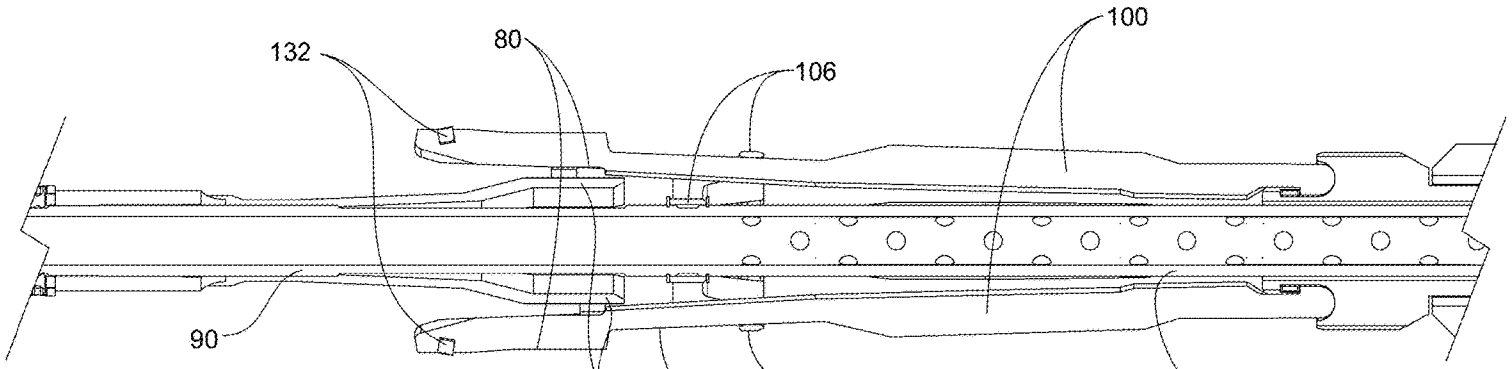
Figure 17E:
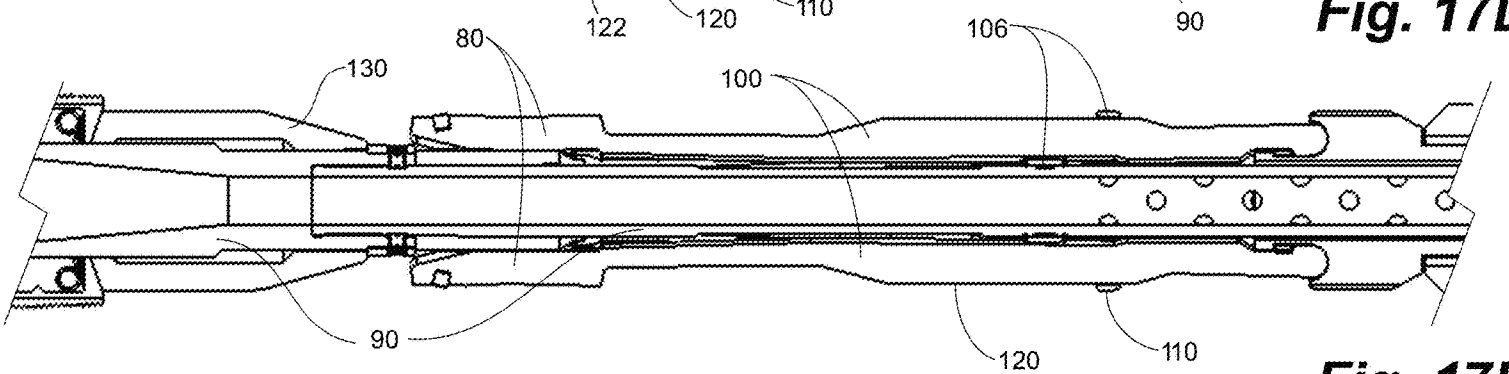
Figure 17F:
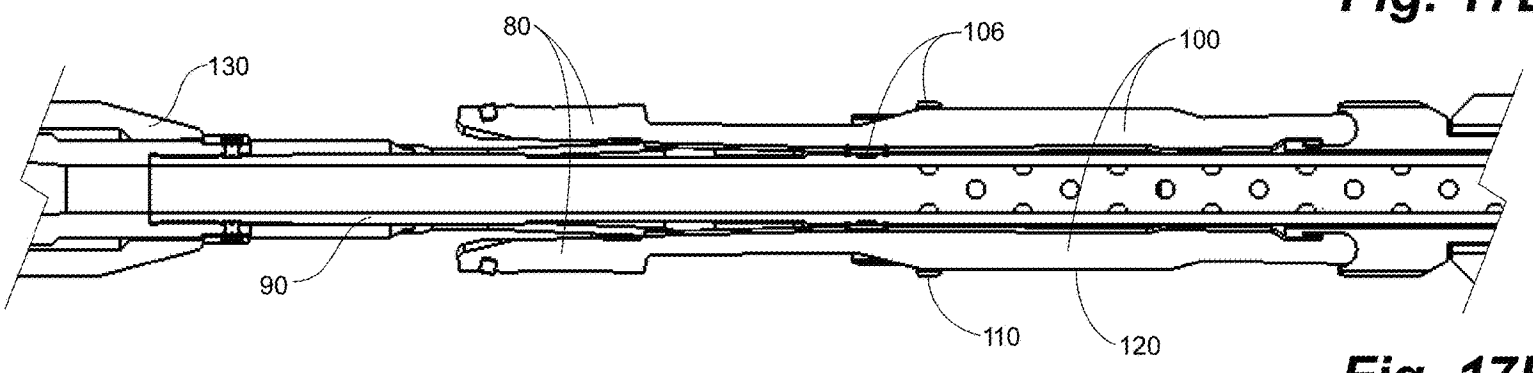

As shown, the engaging surface of the dogs 80 can be designed in multiple configurations depending on the expected application, including with or without button inserts 132 such as those typically fit to slips. The dogs 80, absent button inserts, can be designed with a profile optimized to engage in the sleeve profile but less so in the casing portion of the completion string, allowing locating in both up or down directions and through the sleeve. Alternatively, button inserts 132 can be designed with a profile optimized to engage in the casing but less optimally in the sleeve. For example, as shown in FIGS. 4C and 17D button inserts 132 with a down direction engage in the sleeve profile 50 or the casing 24 and locating of the sleeve 20 would be done while pulling out; or down direction button inserts that engage in the casing but not the sleeve, again locating of the sleeve would be done while pulling out; or up direction slip configurations maybe utilized for alternate operational sequences.

Figure 5A:
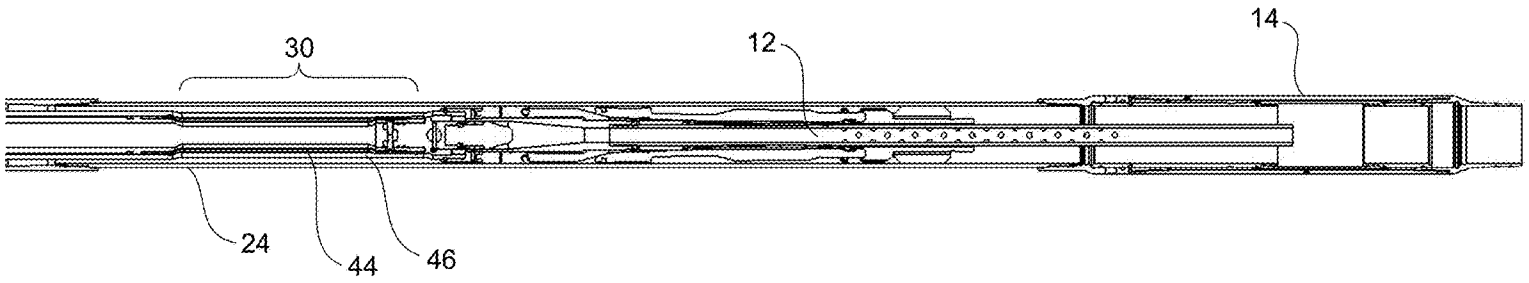
Figure 5B:
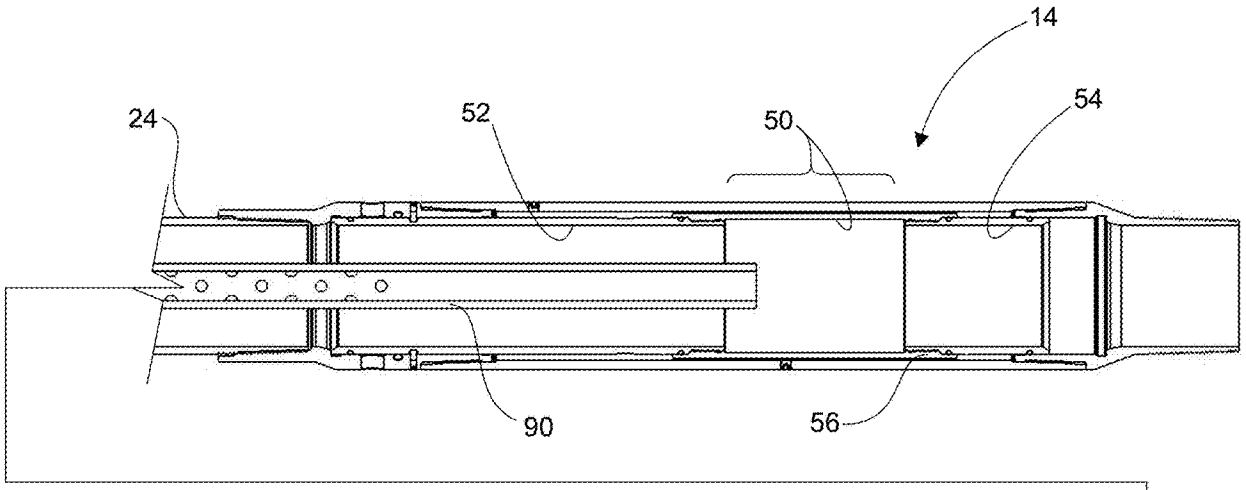
Figure 5B:
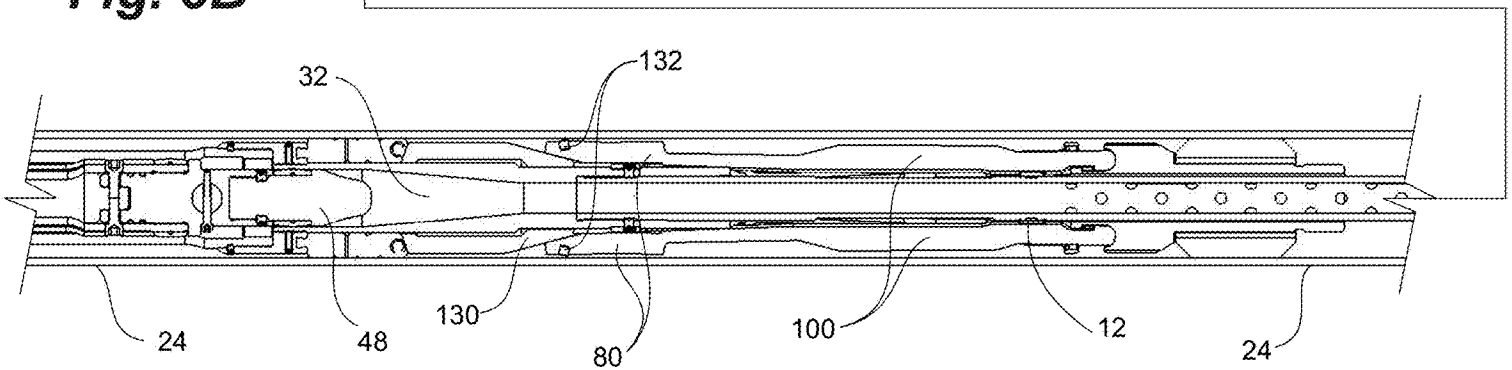
Figure 6A:
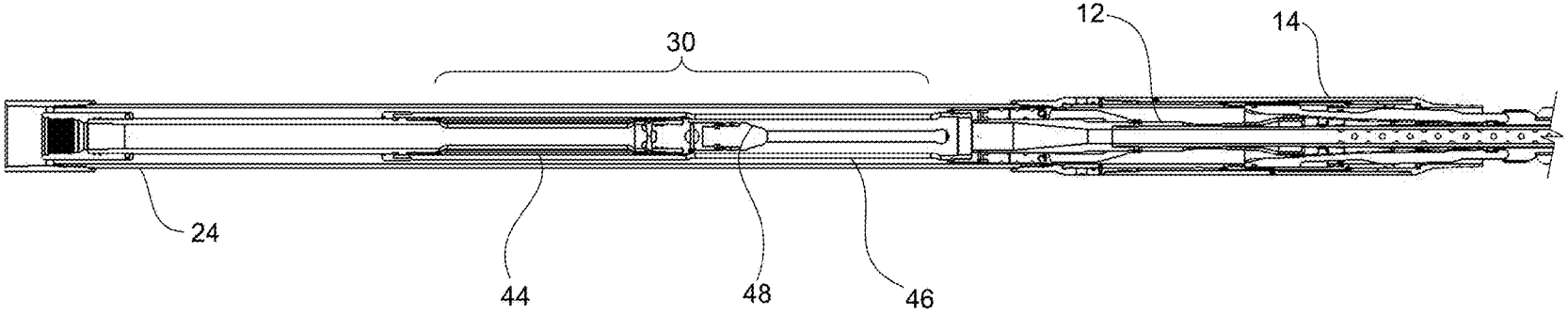
FIGS. 6A and 6B illustrate the tool closing the sleeve through over pulling the coil string weight.
Figure 6B:
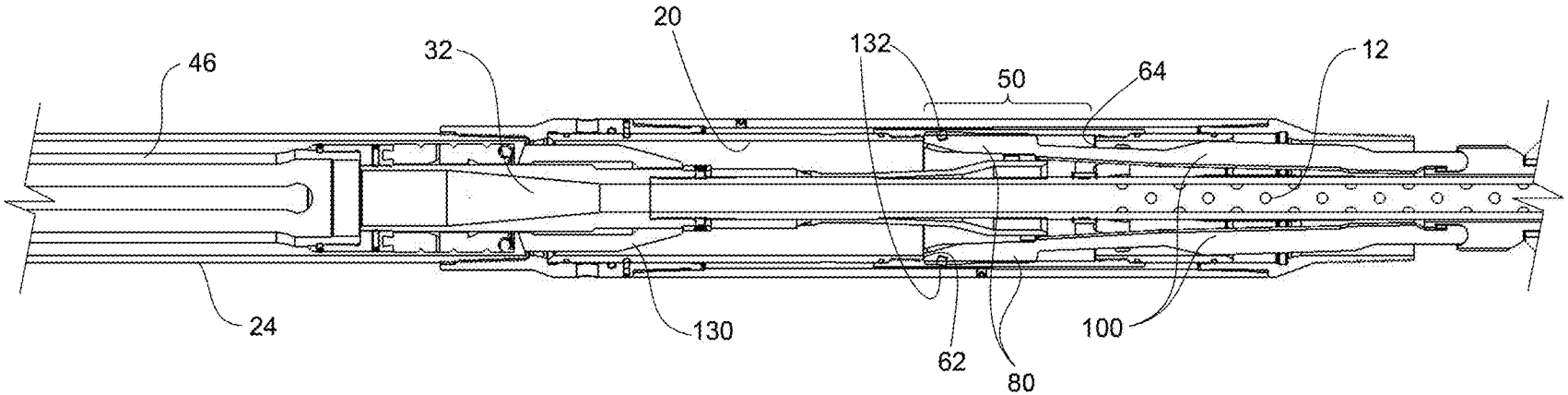

As shown in FIG. 5B, button inserts 132 aid in use of the dogs 80 to act as slips in casing 24 such as to anchor the tool anywhere in the completions string. This is useful where an uphole end of the tool includes an optional abrasajet sub (not shown) wherein the tool can be set anywhere in the completion string 16 and fluid applied to cut ports in the string, such as where a sleeve valve 14 has failed, or where there was no valve placed in the design. Further, insert-equipped dogs 80 enable setting below a sleeve 20 to pressure test the sleeve valve 14, such as to ensure sleeve closure.

With reference to FIG. 13A, the tool includes the J-slot mechanism 92 for indexing the activation mandrel 90 and the J-Slot mechanism having a J-Pin 154 operable in the J-Slot housing 150 and a drag sub 140 to restrain the J-slot housing 150 during cycling.

As shown, the drag sub 140 can include re-tasking a casing collar locator as a drag block, or one can obtain greater normal loads using a stacked beam drag block 142 as shown in FIG. 13B and as introduced and filed by Applicant as U.S. Ser. No. 15/052,663, filed Feb. 24, 2016, incorporated herein by reference in its entirety. The stacked beam drag block 142 configuration uses stacked beam configuration as a drag block to provide robust drag force and reliably function the tool 12 properly moving thru various J-slot cycling sequences. The beam drag block 142 need not locate as to others because the shifting dog 80 and sleeve profile 50 act as a locator. The beam can have a longitudinal extent 143 that is greater than any of the annular cavities (casing collars, sleeve gaps), acting solely as a drag block. Conventional locater dogs, such as those of the drag sub 140 FIG. 13A, engage each annular cavity at every one of the sleeves and due to a shallow engagement angle, there is little load indication at surface, but nevertheless the locator cycles every time and become fatigued.

The present tool 12, equipped with the stacked beam drag block 142 of FIG. 13B, can also be used as a secondary sleeve locator. By shortening the longitudinal extent 143, so as to engage one or more forms of annular recess, the stacked beam assembly can be assembled as a backup sleeve locator as well to engage at measurable, but not actuating weights, herein distinguishable overpull or setdown weights of 3,000 to 5,000 daN over coiled tubing string weight. The advantage is if the dogs 80 are unable to locate the sleeve 20 for any reason, for example in instances which they do not engage because of cement or other debris in the sleeve profile, the stacked beam locator 142 dogs or extent 143 may be able to find enough resistance in the sleeve 20 to locate them. If this is the case, this is a secondary way to locate a sleeve 20 and set the tool 12 and then shift the sleeve open. To avoid the fatigue issue of multiple activations as is the case in the prior art, the stacked beam arrangement provides for high radial engagement load, but well within the elastic deflection limits of the drag block and thus avoids the near plastic and fatigue phenomenon of the conventional locators.

J-Slot sequencing may be set up in a scenario of patterns selected at surface before running in hole by substitution of a J-Slot profile 152.

A multiple functioning toe sub (not shown) can be implemented to open sleeves repeatedly in a well where all other sleeves are closed, forming a hydraulic lock on set tool shifting movement. Shifting a tool string in a closed well often presents a hydraulic lock problem where the shifting tool cannot move into a closed cellar. A toe sub can be provided to allow the hydraulic volume of the fluid to travel somewhere, and be accumulated, so the tool can move. This function may be repeated multiple times in a well.

Tool Operation

Figure 16A:
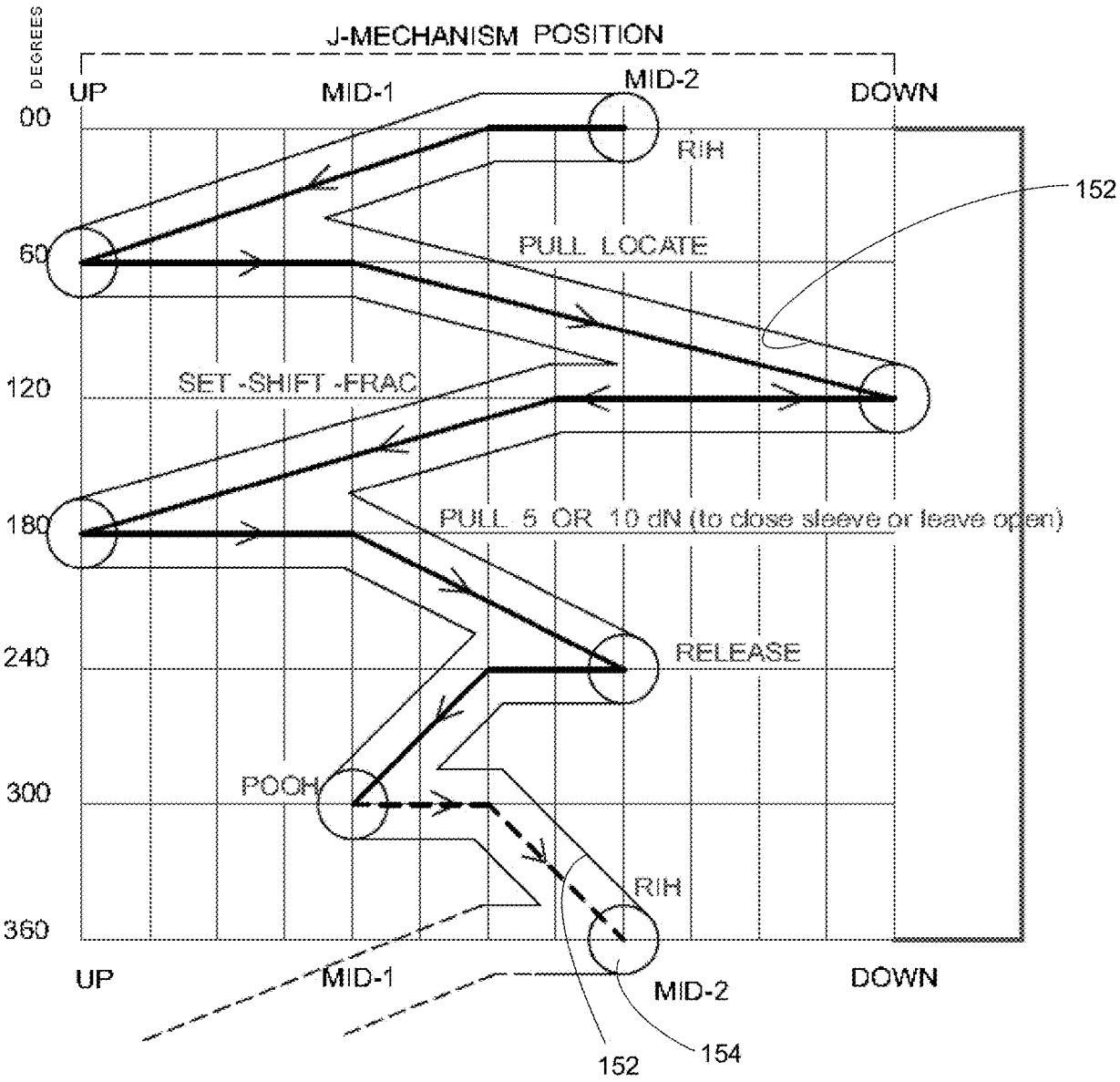
FIG. 16A is a rolled-out view of one embodiment of a J-slot profile suitable for a downhole direction shifting of the sleeve and actuator tool of FIG. 4C.
Figure 16B:
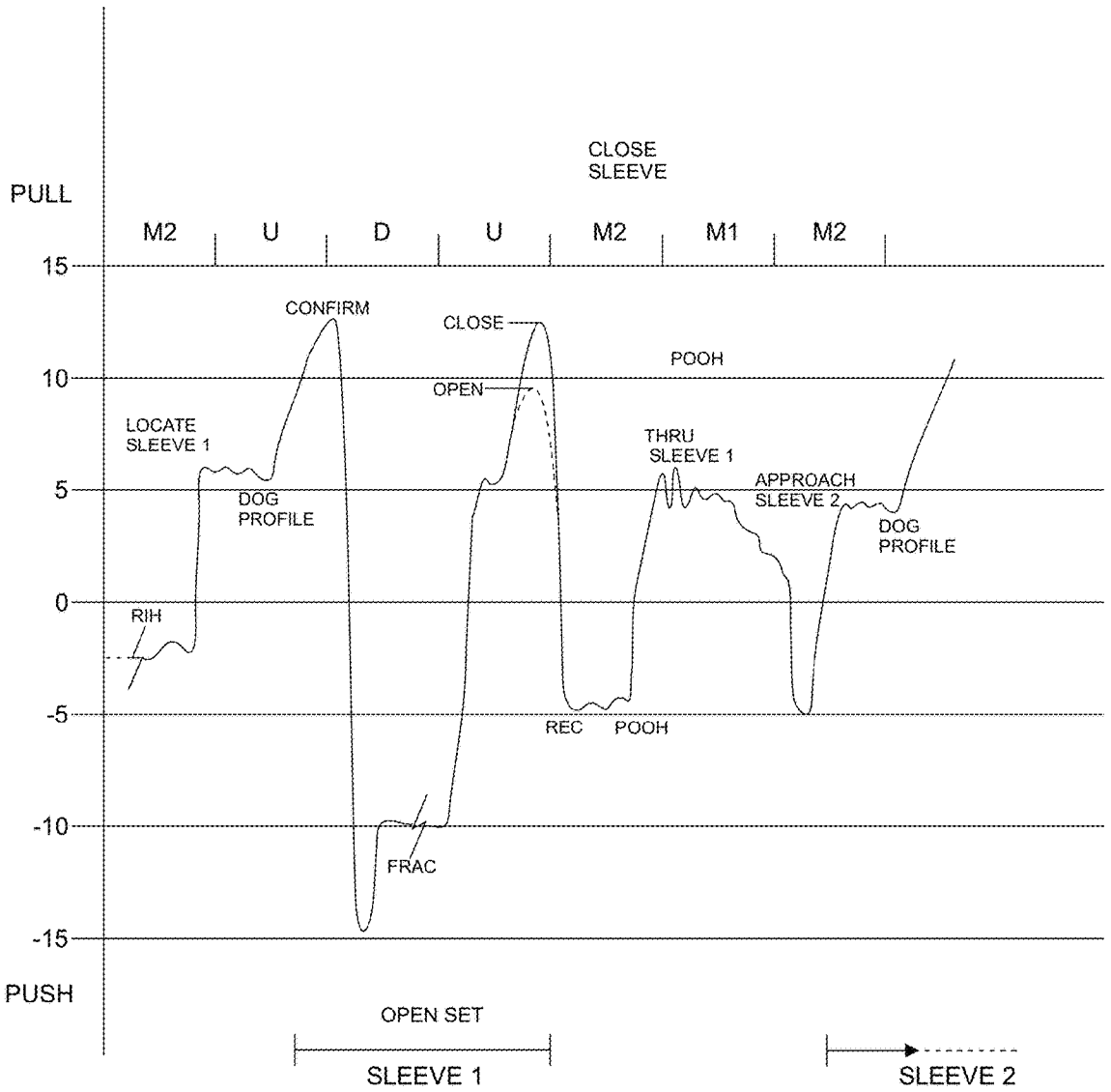
FIG. 16B is a conveyance string weight and sequence for the J-Slot mechanism for a first sleeve, treatment and then subsequent sleeve operation.
Figure 16C:
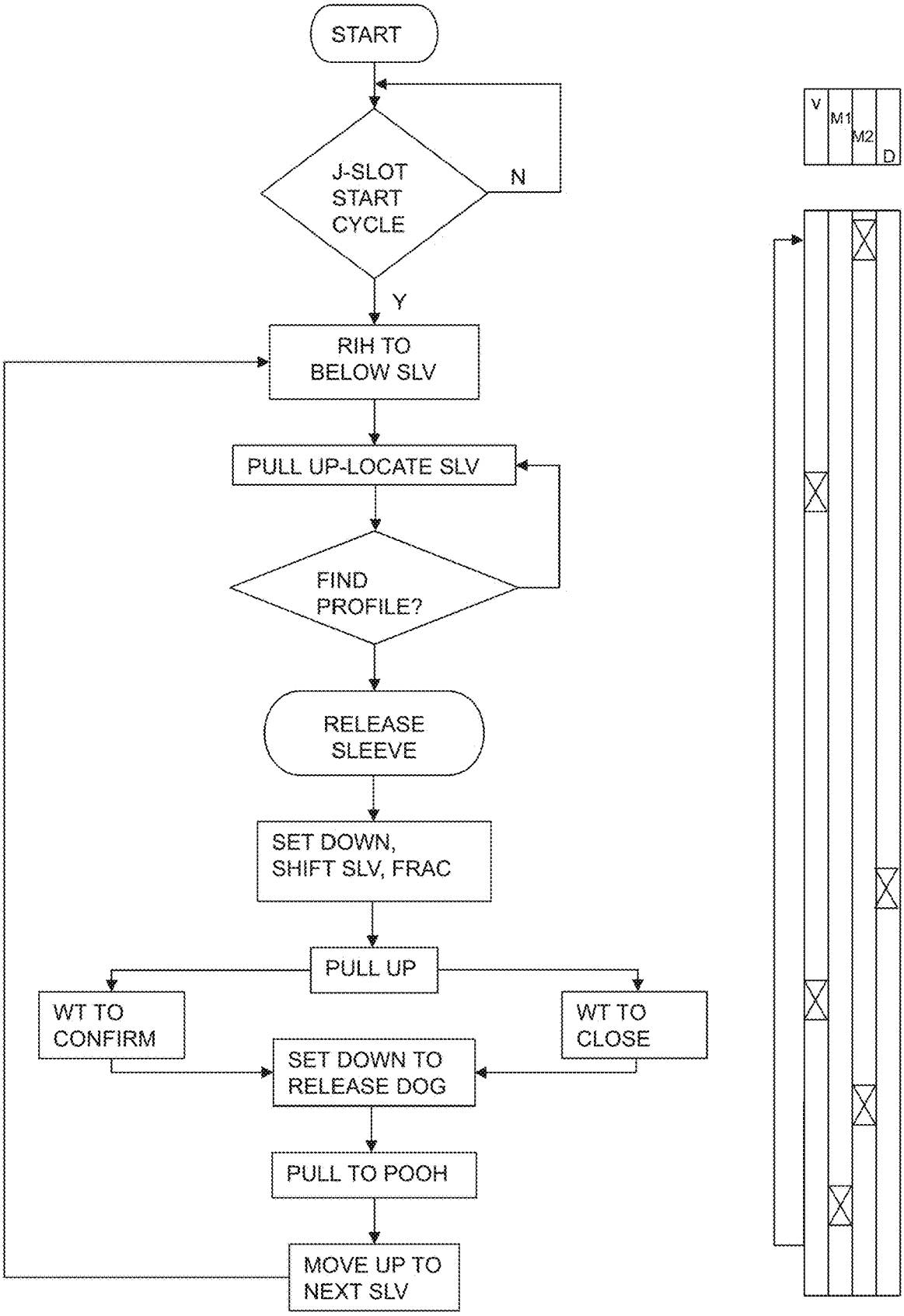
FIG. 16C is a flow chart of the sequence of operation for treatment and optional post-treatment sleeve closing before moving to next sleeve.
Figure 16D:
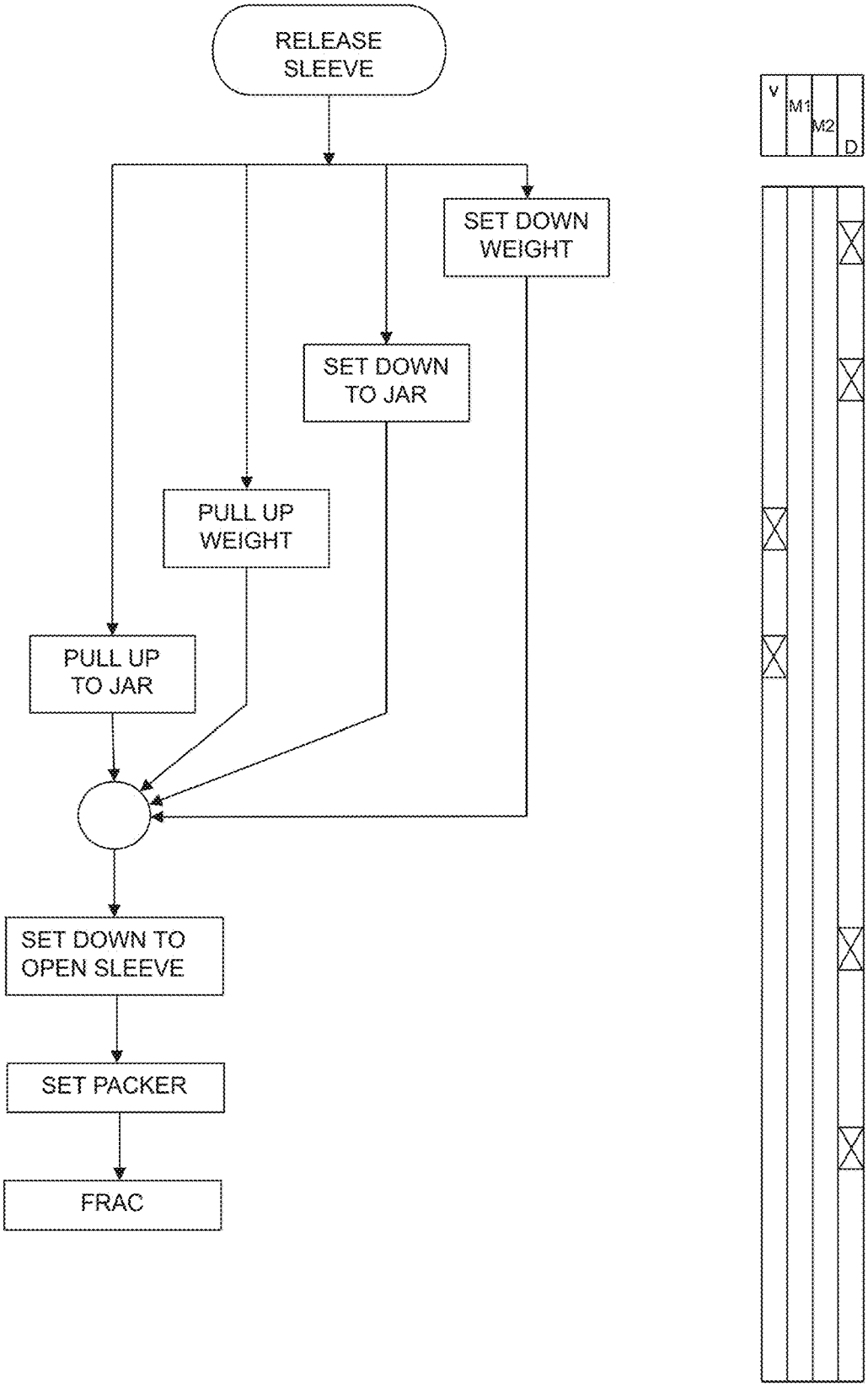
FIG. 16D is a sub-flow chart of the sequence of operation for optional modes for releasing the sleeve prior to sleeve opening.
Figure 16E:
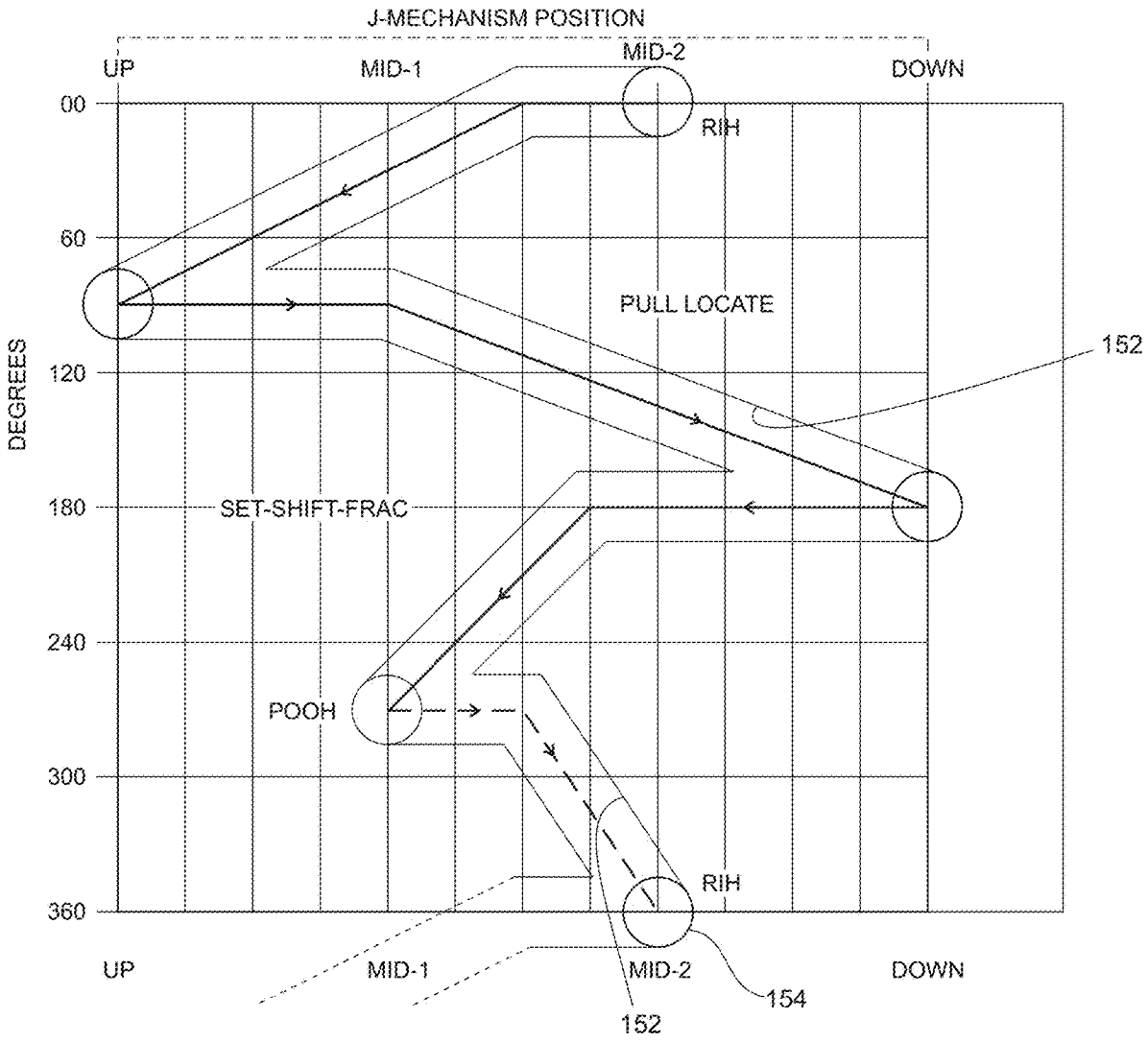
FIG. 16E is a rolled-out view of another embodiment of a J-slot profile suitable for a downhole direction shifting of the sleeve and actuator tool of FIG. 4C.

With reference to the J-slot profile 152 and J-Pin 154 of FIG. 16A, and corresponding operations charts of FIGS. 16B through 16D, several embodiments for operation are provided, with sleeve opening for fluid treatment and optional post-treatment sleeve closing. One is also directed to the drawings of FIGS. 1A through 10B for depicting various stages of the sleeve valve 14 and tool 12 arrangements during said methodology. Illustrations of just the functional components of tool at unique modes of operation are illustrated in FIGS. 18A through 18D and FIGS. 20A through 20D.

Generally, the J-Slot sequence as shown in FIG. 16A has four axial positions, distributed circumferentially 6 unique circumferential modes. Of the four axial positions two are extreme positions: one extreme position that drives a cone into engagement with the dogs to locking the dogs to the sleeve profile; and the one second extreme position that first frees the dogs for locating along the inside wall of the completion string for locating the sleeve profile.

The remaining modes are intermediate axial positions, both of which restrain the dogs' radial position to enable free movement up and down the conveyance string.

With reference to FIGS. 16B and 16C, the uphole and downhole movement of the tool is illustrated, and example net tubing weights needed to effect the steps in the method. Reference can be made to these drawings as the various modes are described as to the apparatus configuration as follows.

Figure 1B:
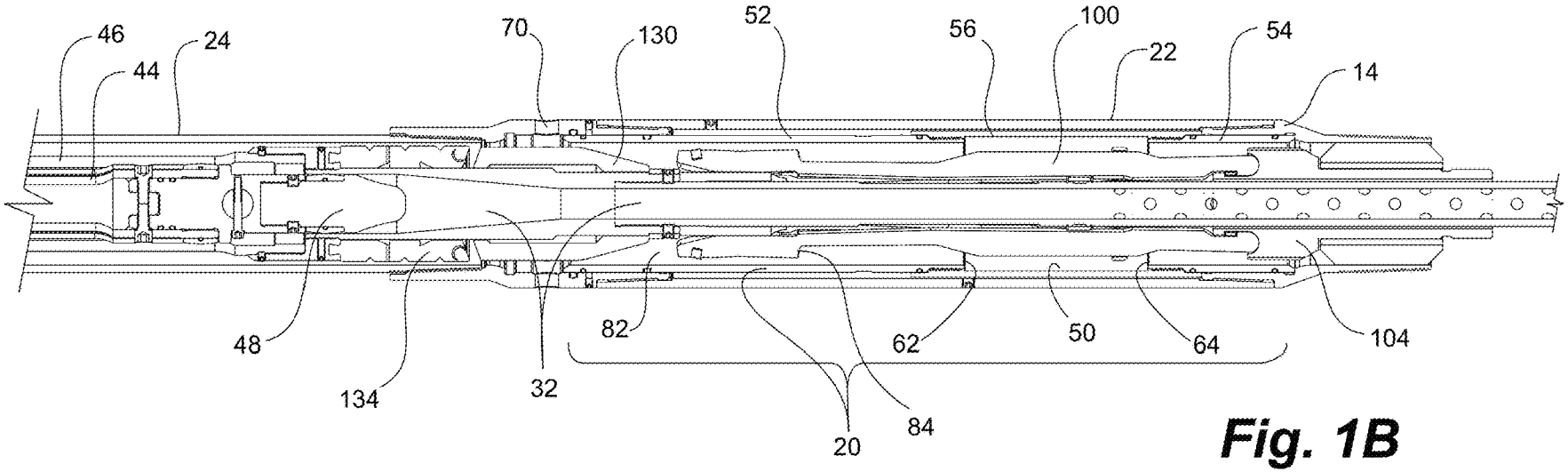
Figure 20A:
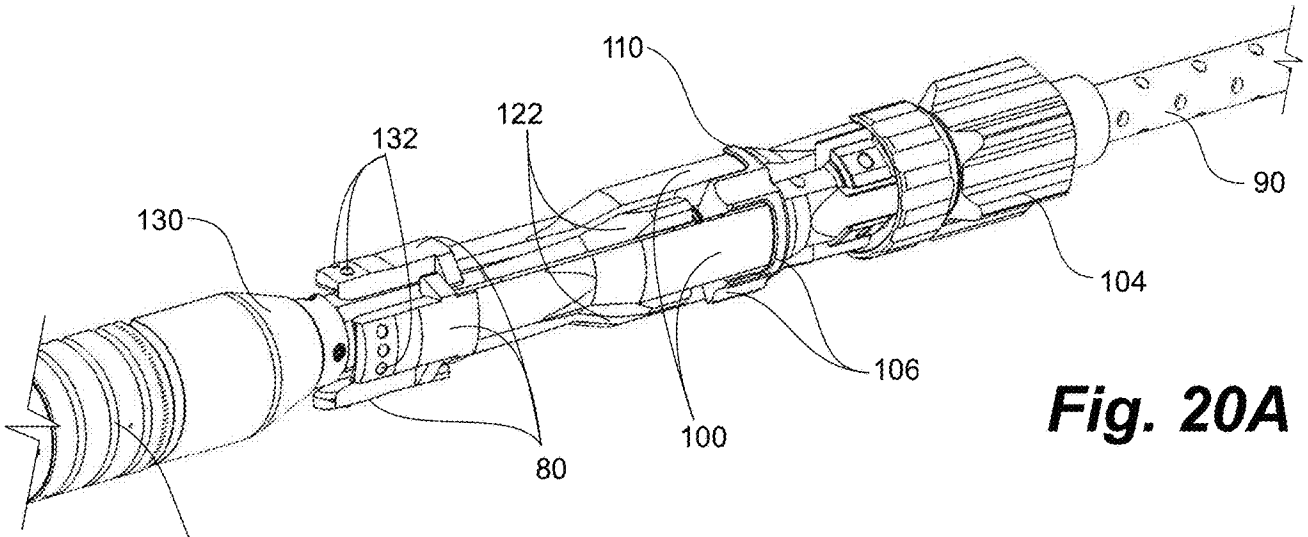
FIGS. 20A through 20D are perspective views of the opposing side view of the sectioned tool according to FIGS. 18A to 18D, again of the activation mandrel, arms supporting the dogs and the restraining ring portion of the tool for the biased locator mode, the set mode, the pull-out-of-hole, and the run-in-hole mode respectively.
Figure 20B:
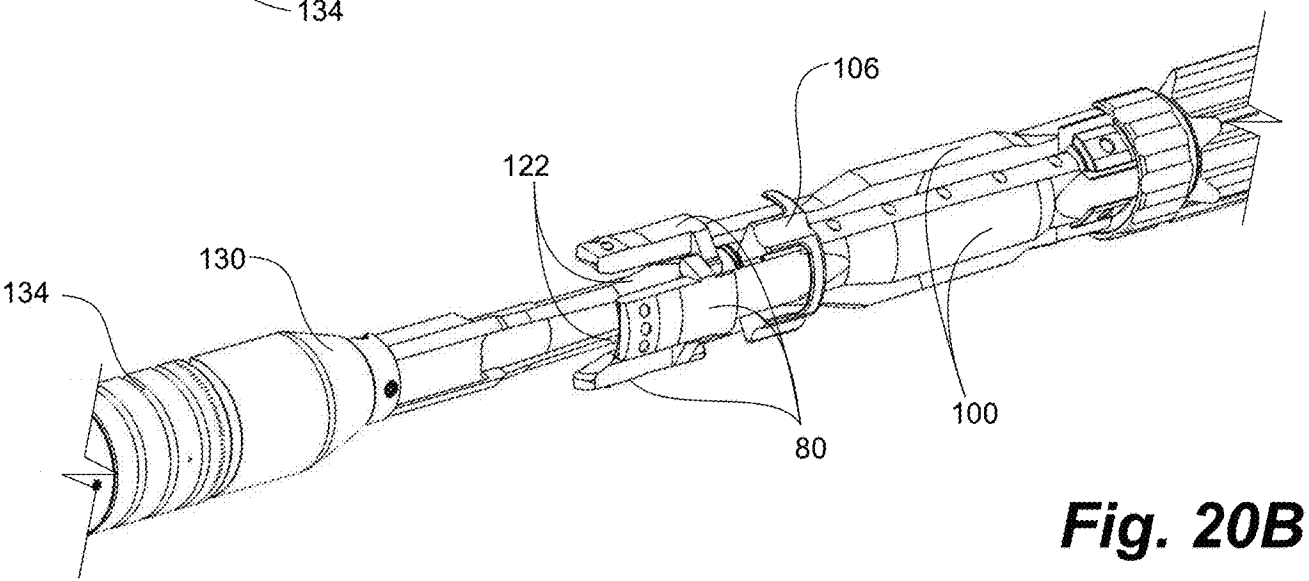
Figure 20C:
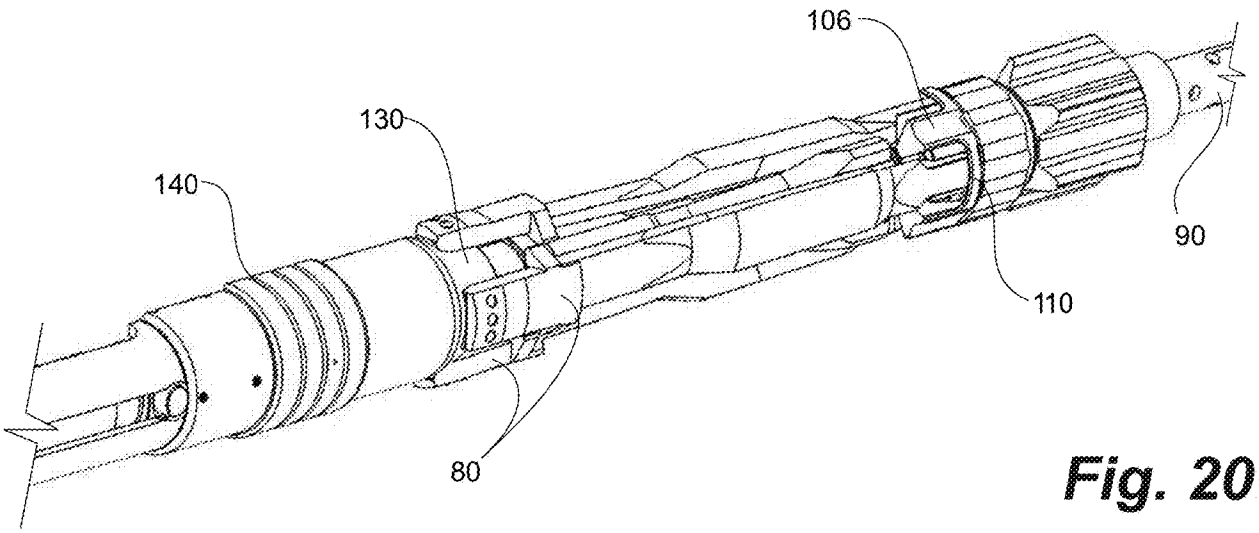
Figure 20D:
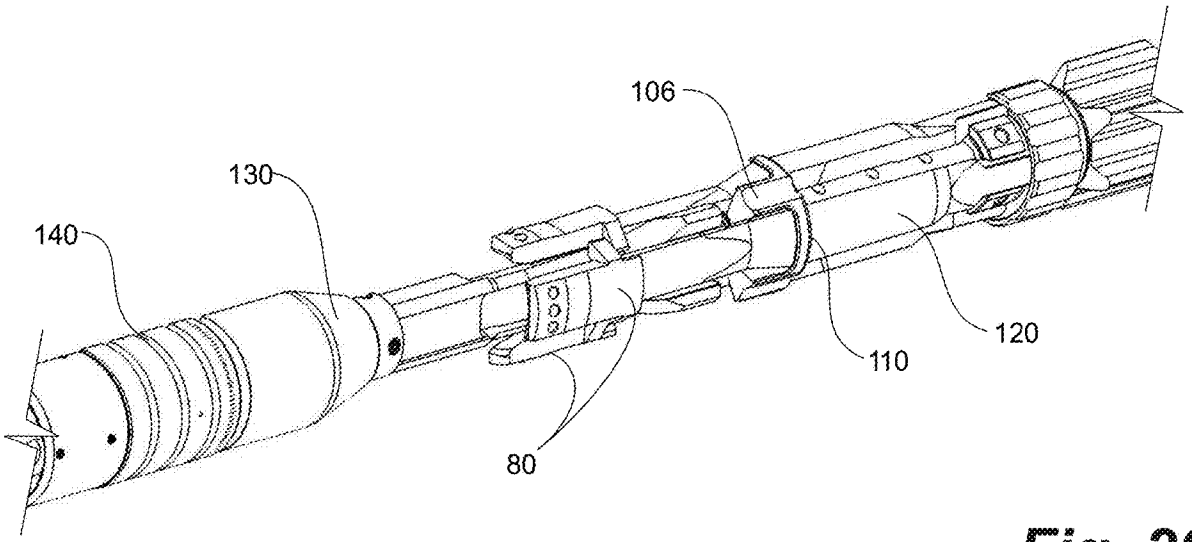

With reference to the arrangement of FIGS. 1A, 1B, the dog mode of FIG. 17A, and the tool components of FIGS. 18A, 20A, the actuator tool is shown running in hole (RIH) with the dogs of the tool radially collapsed, retracted or restrained, controlled by the J-slot sequence M2 of FIG. 16A. With the dogs 80 restrained, the tool will not engage on any profile travelling into the well, including sleeves or casing collars. Thus, the dogs are not cycled repeatedly and are not subject to fatigue.

As shown in isolation in FIGS. 19A, 19B and best seen axially positioned in FIG. 17A, the annular ring 110 of the shiftable retaining ring 106 prevents the dogs 80 from being activated. As shown in the end cross-sectional view of FIG. 19C, the annular ring 110 engages an upstanding portion of the each arm's cam 120, holding the arms close 100 to the activation mandrel 90. The drag block 142 beam system maintains friction force with the outer mandrel of sufficient load so as to maintain the J-Slot mechanism 92 in a running position and not permit it to function or cycle in vertical or horizontal hole, thereby preventing any premature setting of the tool in the sleeves 20 or the casing 24.

Depending on the selector valve 30 configuration, fluid may be circulated down the conveyance coiled tubing and returned up the annulus during RIH or forced into the formation if a toe sub was utilized and is open.

The dog arms 100 are contained radially by the annular ring 110. The restrictor or annular ring 110 is axially fixed to the main inner tool activation mandrel 90 and, as the activation mandrel 90 travels from position to position, the annular ring 110 guides the arms 100 radially to their respective position with respect to the J-Slot profile position. Outward force on the arms 100 is managed by the compression spring 122 under the dogs 80. This outward force is compressed to the appropriate radial position by the annular ring 110 and the force required to manage compression of the spring 122 during axial movement is overcome by the drag block 142 stacked spring assembly.

Figure 2A:
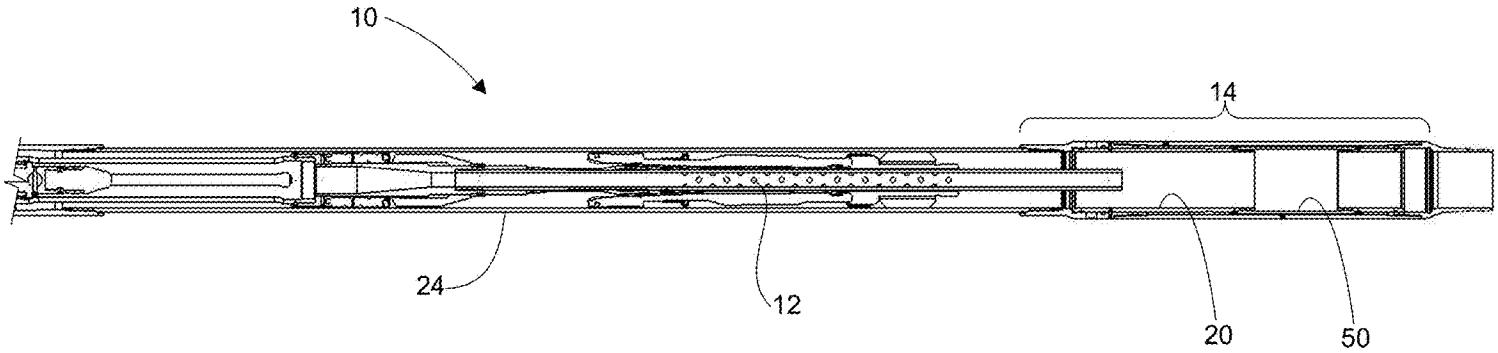
FIGS. 2A and 2B illustrate the tool as it is pulled up in casing with the tool's dogs in locate mode.
Figure 2B:
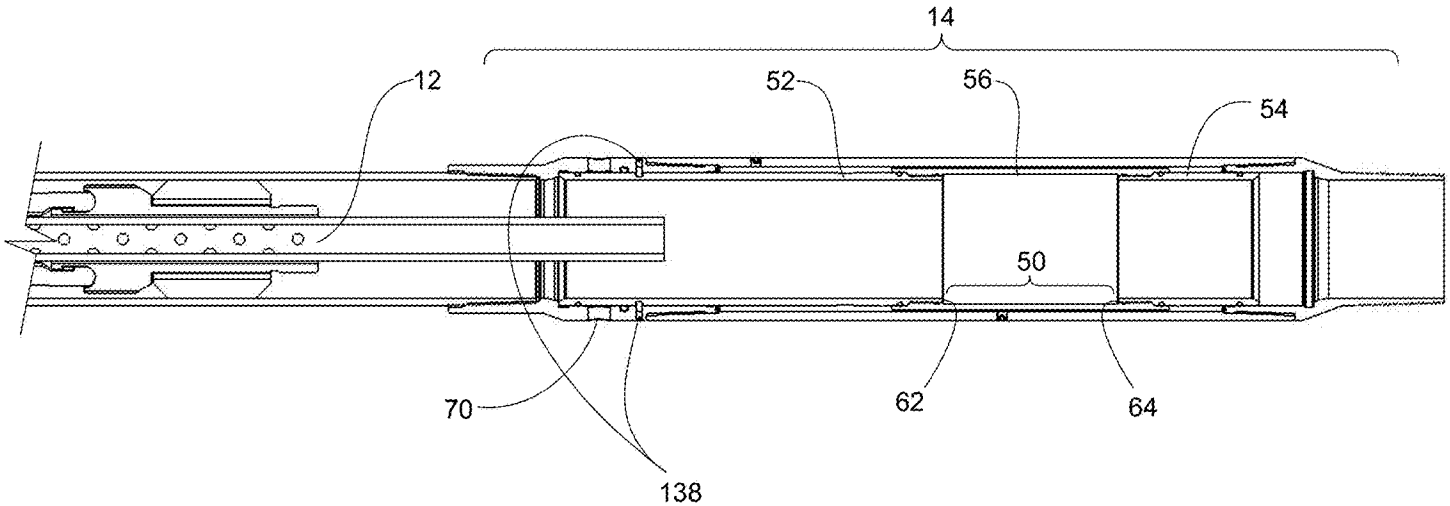

With reference to the arrangement of FIGS. 2A, 2B, FIG. 17B, and FIGS. 18B, 20B, the actuator tool 12 is shown being pulled uphole, such as to locate the next sleeve uphole of the illustrated sleeve 20 of FIG. 2A. Sleeves may be activated in any sequence in the well, from heel to toe, or toe to heel or alternatively any other combination is also available. Once the desired depth is obtained, in this embodiment, below a sleeve valve 14 of interest, the tool 12 is cycled from RIH to Pull to Locate.

The uphole movement the coiled tubing moves the inner activation mandrel 90 of the tool to transition the J-Pin 154 in the J-Slot profile 152 to the U position, while the outer housing 150 of the J-slot mechanism 92 is held rotationally static in position by the drag blocks. The drag blocks 142 provide sufficient axial restraining force for the biased energizing of the dogs 80 outward towards the casing 24. The arms 100 and dogs 80 are held against the casing with a spring force and this force can be adjusted on a per dog basis or group basis as the case may be. The springs 122 are cantilevered leaf or collet-like springs, the ends of each leaf radially biasing the arms outwardly. The force on the dogs is also balanced even if the tool is not centralized in the well. This can aid if the sleeve profile is contaminated with sand or cement and not all the dogs can engage the profile. Only one dog 80 is required to engage the profile 50 to ensure surface-detected location of the tool in the sleeve. The dogs 80 are designed in such a way that one dog alone can withstand the entire load capacity of the coiled tubing injector at surface. This design is a positive location; once engaged, it remains engaged until the J-Slot 92 is cycled or an emergency release is actuated.

Positive location is a significant departure from the conventional sleeve tools. The movement of a tool is often many kilometers downhole, and the coiled tubing string mechanics associated therewith are significant.

In the conventional slip form of sleeve engagement and shifting, two practical problematic situations can occur despite the theory of sleeve locating, slip engagement and sleeve actuation. One, by the time a sleeve location is indicated at surface, through weight change at the injector, the locator may have already moved uphole of the desired or ideal location. Thus when the slips are set, presumably properly positioned at some intermediate point in the sleeve, the tool may actually be set high, and the seal above the slips could interfere with the top of the sleeve and even obstruct the ports. Secondly, even if properly positioned in the sleeve when the set and shift operation is commenced, upon setting down, the slips do not always immediately grip the sleeve and slide therein before cutting in, sometimes only engaging low in the sleeve, resulting in significant annulus that can collect debris, or not even set in the sleeve at all.

Positive sleeve location is an important factor in objectives to minimize sleeve length and cost. Without positive, dog to sleeve indication, optimizing the shortest sleeve possible is difficult if not impossible, else there simply is not enough room for axial placement errors including setting high or too low. On uphole movement during locating, the disclosed dogs 80 will not engage any annular recess but the sleeve's profile, and once engaged, there is no accidental movement to permit one to pull out of the sleeve profile 50, the dogs 80 being locked in the profile, unless emergency release tactics are required.

With the dogs 80 engaged in the profile 50, only extraordinary efforts will permit the coiled tubing string to move, transitioning from locating to shifting the sleeve. If there was a tool failure, the dogs 80 may be released from the sleeve profile 50 by cycling the tool 12 or pulling extreme loads on the coiled tubing to force the dogs into collapse.

The importance of a short sleeve 20 is to achieve a sleeve valve 14 having less material and so avoid the common practice and need for mechanical handling of longer tubulars including preceding and/or following pup joints, the pup joints adding further weight as needed to enable mechanical handing of the already heavy, and now heavier components. Alternatively, with lighter sleeve valves 14, simply the valve needs to be man handled and need not be combined with pup joints. Most drilling rigs can accept short components if they are short enough and light enough to be handled by hand, not requiring handling hardware or equipment. If this can be achieved, a cost reduction to the sleeve manufacturing and installation can be realized and significant.

With reference to the arrangement of FIGS. 3A, 3B, FIG. 17B and FIGS. 18A, 20A, the actuator tool 12 is shown located in a sleeve profile 50. As the dogs 80 move uphole through the sleeve valve 14, from the casing 24 to the sleeve 20, the dogs 80 are designed not to locate in any sleeve gap at the bottom of the sleeve when the sleeve is closed, such as designing the sleeve profile 50 with an axial length unique and longer than other annular recesses. The sleeve 20 is formed with a sleeve profile 50, such as that formed between the uphole sleeve portion 52 and the downhole sleeve portion 54 connected by a collar 56, the collar 56 forming the profile 50. The dogs 80 engage the profile 50 and the coiled tubing and tool 12 are prevented from traveling further uphole, providing positive indication at surface (say about 5,000 to about 10,000 daN) that the sleeve 20 has been located. This prevents the tool 12 from setting elsewhere in the sleeve. The problem in the industry currently with conventional locators is once the location is found (casing or sleeve) the prior art sleeve locators can jump through the location position without being detected when the tool is transitioned at surface from to the set mode to shift the sleeve, ultimately setting the tool high in the sleeve. Setting the tool high in the sleeve means the sleeve design must be conservatively and purposefully longer, but this renders it unmanageable with respect to length and weight to be handled by hand or without adding supplementary handling tubulars, increasing cost. The other outcome of setting the tool too high in the sleeve runs a risk of setting the element across the frac ports when the sleeve is open, not allowing the treatment or frac fluid to be pumped into formation. Locating the sleeve in this way eliminates ambiguity at surface regarding the location in the sleeve. This is important in troubleshooting issues from surface and increasing time and operational efficiency.

With reference to the arrangement of FIGS. 4A, 4B, 4C, 17C, 17D, and FIGS. 186, 206, the actuator tool 12 is shown set in the sleeve 20, the sleeve shifted downhole and the sleeve valve open, ready for treatment fluids.

To lock the dogs 80 into the sleeve profile 50, the next motion is to RIH with the coiled tubing from the sleeve location cycle. During this transition the tool 12 is held in positon by the drag block and the inner activation mandrel 90 travels downhole, also moving the annular restraining ring 106 to its downhole-most position adjacent the pivot 102, maximizing the arm movement. Similarly the cone 130 moves with the activation mandrel downhole to approach the dogs 80. The radially outward biasing of the dogs with the compressed spring is locked with the ramped face of the cone 130 and dog 80 engagement. The cone 130 mechanically forces the dogs 80 outwards. During this transition each dog's lower shoulder 84 engages with the bottom shoulder 64 of the sleeve 20 creating an interference fit. The dogs 80 cannot travel down they are trapped ensuring that the tool 12 does not set low in the sleeve 20. Setting low in the sleeve is an industry problem because if the tool is relying on slips the slips could slide allowing the tool so move downhole. This could create a problem shifting the sleeve because if the slips move off the inner sleeve down hole it's impossible to shift the sleeve. If the sleeve is shifted with the slips at the bottom end of the inner sleeve this allows for more frac debris to be placed on top of the element below the frac entry ports on the sleeve, creating more problems pulling off the zone due to interference with the frac sand that may have accumulated in the space during the frac treatment.

With the dogs 80 engaged, a packer element 134 is compressed between the activation mandrel 90 and the cone 130 to seal within the completions string 16 and the bypass valve 48 through the bore 32 of tool 12 is closed.

If it's required, the sleeve 20 can be shifted down with coiled tubing force from surface and/or fluid pressure above the tool 12. With reference to FIG. 16D, there are other options to release the sleeve so as to enable shifting open including an initial overpull uphole, or using a jar, or using persistent tubing weight to overcome a hydraulic reservoir.

Herein, a sleeve 20 is provided where the initial shift of the sleeve can be controlled by overcoming shear screws 138 with a predetermined shear strength. Once the shear value of the screws 138 (number of screws may be adjusted to specific operating parameters) is overcome the inner sleeve 20 is allowed to travel down. Further, a sleeve shift dampening system (not shown) can be provided (See US published patent application US20150013991A1 to Applicant, published Jan. 15, 2015). The dampened sleeve controls the acceleration of the internal sleeve and the shock load when the sleeve reaches its shoulder end travel position. By minimizing this shock load the tool longevity is greatly increased and the fluid hammer shock load to the open formation is contained, this is important not exceed the frac breakdown of the formation.

Opening the sleeve 20 is indicated at surface by a reduction in coiled tubing string weight. This is important in the event of troubleshooting problems breaking down the formation for example, because it eliminates the concern of sleeve malfunction. Again, having a profile sleeve also eliminates the high or low setting of the tool, which further minimizes troubleshooting formation breakdown.

Figure 12A:
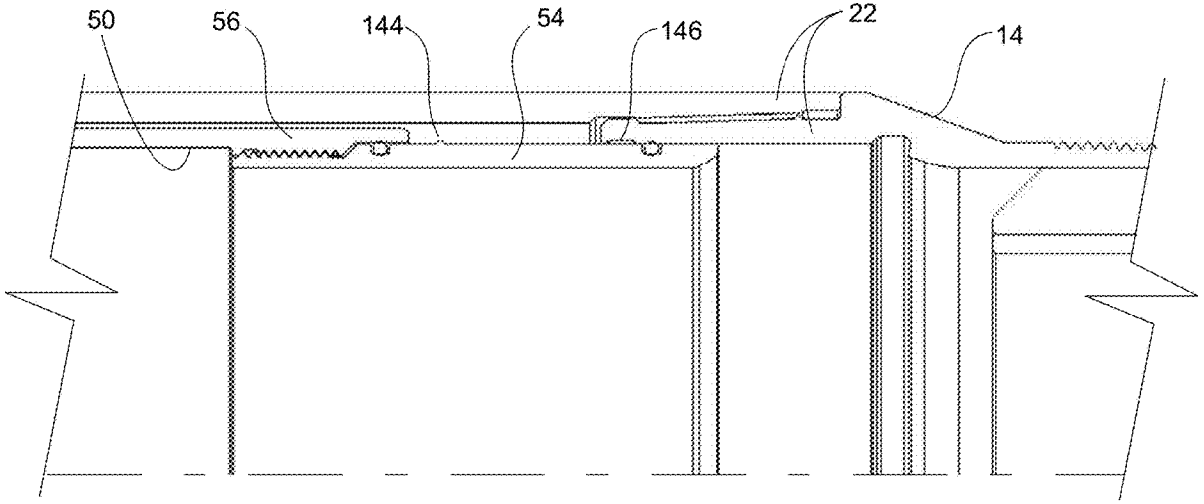
FIGS. 12A and 12B illustrate a close up of a sleeve housing and sleeve end having a locking device in the unlocked, and locked positions respectively, the locking device restrained in the extreme position.
Figure 12B:
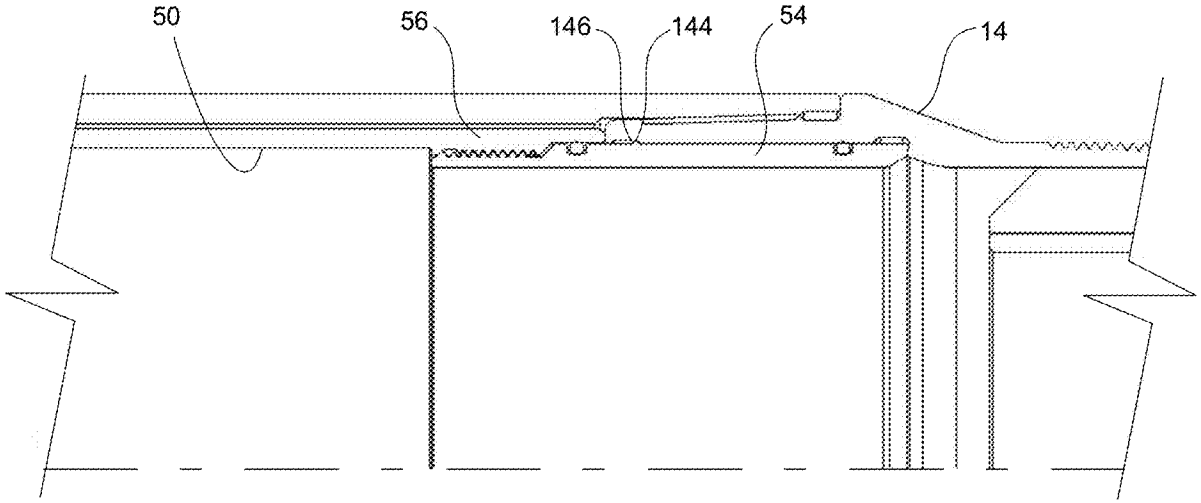
Figure 15A:
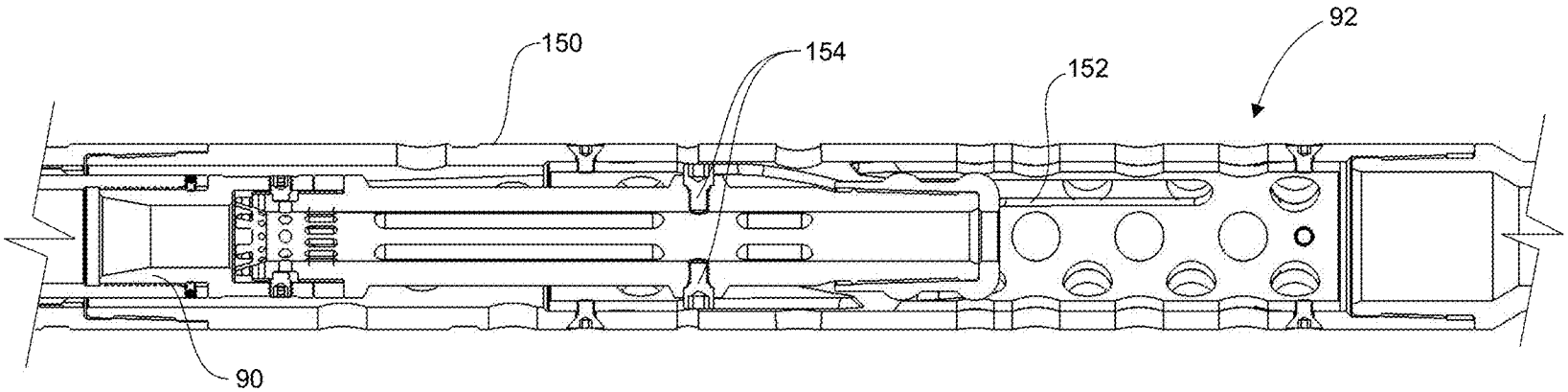
FIGS. 15A and 15B illustrate the J-Slot mechanism of FIG. 14 in the extreme uphole and extreme downhole positions respectively.
Figure 15B:
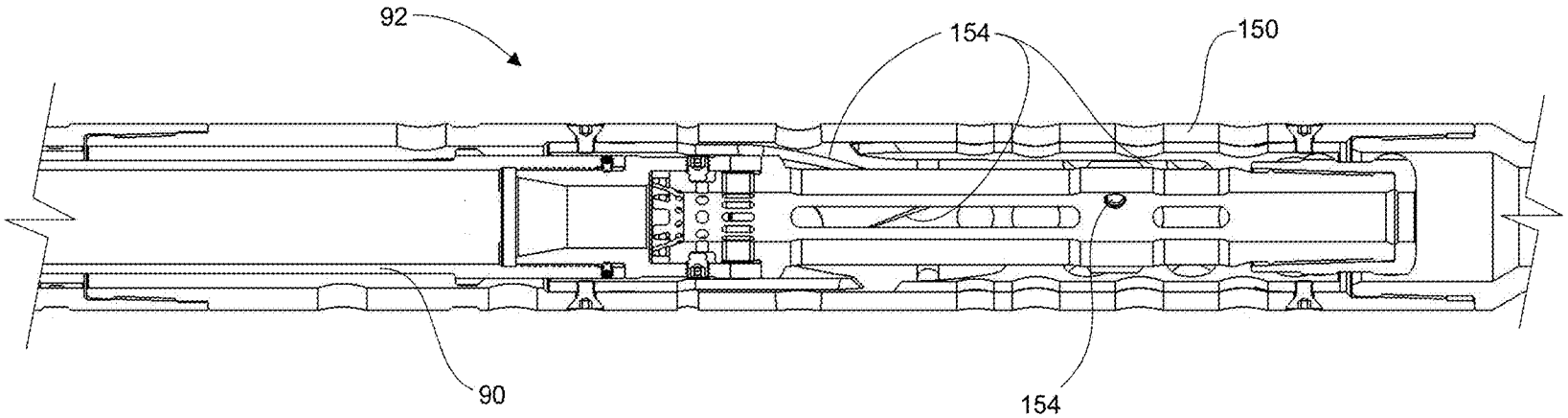

Pull or push loads to close and re-open of the sleeve 20, after the initial opening of the sleeve, is controlled by an annular detent assembly (See FIGS. 12A and 12B) on the upper and lower ends of the sleeve 20. As shown, a locking device is shown in the unlocked and locked position respectively. In FIG. 12A, a detent 144 is located along an outer diameter of the lower sleeve portion 54 and a detent recess 146 is shown on an inner diameter of the sleeve housing 22, the recess 146 facing detent 144. In FIG. 12B, the detent 144 and detent recess 146 are coupled to resist release therefrom. This detent release load is typically set to 5,000 to 10,000 daN for example.

Particularly for the bottom sleeve, shifting the tool down hole requires relieving the hydraulic compressional forces created in the casing 24 below the tool 12. Similarly, downhole shifting can be challenging if no other sleeves/ports are open to formation downhole of the sleeve being shifted. A multi-set activation sub (not shown) is provided to allow fluid to travel somewhere while the tool is shifted, such into the sub. Once the tool is released after the frac the activation sub is reset so another sleeve can be shifted. If a port is open in the well below the tool, the activation sub may be eliminated or remains inactive.

With the dogs locked relative to and below the frac injection point, the ports in the sleeve are optimally aligned every time, minimizing turbulent flow of the frac fluid preventing undesirable circumstances like screening out in the wellbore especially with high frac rates or high density or both. Better alignment also promotes less wear on the tools when frac'ing through the annulus or tubing or both.

With reference to the arrangement of FIGS. 5A, 5B the actuator tool 12 is shown set in casing 24. In the event the sleeve does not function properly or the sleeve does function or the formation/reservoir refuses to break down under treatment, button inserts 132, such as carbide inserts installed on the face of the dogs 80 can act as slips. The radial arc of the slip in the diameter of the sleeve versus in the diameter of the casing is different therefore the slip arc may be configured to act as a slip in the casing, yet less so in the sleeve or vice-versa in other embodiments.

This feature of engaging the dogs 80 as slips in the casing 24 allows for the option to set the tool 12 in the casing to allow for random pressure testing and or fracturing the well in a different location other than the sleeve. For example by the use of balls or manually actuated valves above the tool 12 fluid flow may be diverted from the frac flow to an abrasajet cutting head above the tool that can be used to cut perforations in the casing and then by setting the tool in casing 24 below the perforations and generally above the formation in accessible sleeve the frac stage may be placed in close proximity.

Setting in casing also provides the ability to isolate pre-perforated perforations with an isolation configuration of the tool or abrasajet cut all the perforations of a new well not using sleeves at all.

The tool may also be utilized in a hybrid well configuration where there are a combination of abrasajet cuts and sleeves, or pre-perforated areas and sleeves or pre-perforated areas and abrasajet perforations.

The tool may be set up with a spring retention element in combination with a bypass valve, or the tension element with or without the bypass (see Applicant's U.S. application Ser. No. 15/013,983, entitled Tension Release Packer For A Bottom Hole Assembly, filed Feb. 2, 2016), incorporated herein by reference in its entirety. Another significant advantage is an optional elimination of the bypass valve 48. Bypass passage and valves enable bypass fluid flow, however, if a suitable annular bypass is possible, a valve-bore 32 need not be made available. The tension element is designed to pull away from the annular walls and pressure after a frac with more efficiency than the conventional spring retention element, this seal release mechanism providing an annular release means to eliminate the bypass valve. Bypass valves are sliding members, the elimination which would simplify the overall tool.

Setting in casing can be achieved by cycling the J-Slot to RIH-M2 and pull locate U and positioning the tool, then setting down to the set-shift-frac (U) mode.

With reference to the arrangement of FIGS. 6A, 6B, FIG. 17B, and FIGS. 18B, 20B, after treatment, one can choose to close the sleeve or cycle the tool to move to the next zone. In this downhole shift embodiment, if one chooses to close the sleeve 20, this can be achieved with an overpull sufficient to overcome the downhole detent of FIG. 12B. Depending on the detent design threshold, the detent 144, 146 can be overcome by over pulling the coiled tubing string weight beyond a threshold such as over about 5,000. A typical range is between 5 to 10,000 daN, or even above 10,000 to upwards of 15,000 daN.

When the sleeve was first opened the detent, such as an annular lip detent 144 about the sleeve at the downhole end of the sleeve engaged a corresponding annular detent, ratchet or receiver recess 146 to retain the sleeve 20 in the open position until purposefully actuated. The tool can be cycled uphole by overcoming the detent and then cycled downhole again at some later time downhole. Cycling uphole either enables J-Slot transition to the next stage, or confirms the sleeve was engaged. Cycling downhole thereafter transitions to the next stage.

One can cycle the tool uphole, at a weight indicated at less than a threshold to leave the sleeve open, and then be cycled down. Alternately, one can cycle the tool uphole, at a weight indicated greater than a threshold to overcome the detent, close the sleeve, and only then cycle the tool down.

Thus, upon completion of the frac, the sleeve may be closed or left open. Thereafter, the coiled tubing is cycled down to release the cone from the dogs, and cycle the J-Slot to M2 in preparation for moving uphole or POOH.

During uphole movement, for closing the sleeve 20, the inner activation mandrel of the tool starts to move uphole, opening the bypass valve 30, 48 and tension release of the annular packer seal. The pressure across the tool 12 is equalized and debris is flushed from the tool. The cone 130 disengages from under the dogs 80 and the inner activation mandrel 90 transitions from locked dogs to spring biased or supported dogs. During this transition the dogs 80 do not move in the sleeve 20, still being engaged with the profile 50. The dogs 80 do travel axially from the lower shoulder 64 in the sleeve locator to the upper shoulder 62.

When the dogs 80 engage the upper shoulder 62 the net weight indication is indicated at surface. This weight indication can be set to any loading or threshold, in this case 5,000-15,000 daN over coiled tubing string weight. This weight range is selected because the loading is significant enough to realize at surface.

The purpose of closing the sleeve right after the frac includes: isolation of the frac treatment in the reservoir by not allowing it to flow back into the well. By isolating the frac treatment this allows for the formation to heel containing the frac sand and reducing sand production in the well which ultimately would have to be recovered at some expense; isolation the frac treatment from other previously frac'd sleeves/stages to prevent cross flow in the well; and minimizing the amount of clean fluid required to clean the tools up travelling to the next stage.

The sleeves may be re-opened at any time, for example if a well is frac'd from the toe to the heel, once the last sleeve is closed at the heel the coiled tubing can travel back to the toe and the process of locating and opening all the sleeves can begin back to the heel. The sleeves can be opened days/weeks/months later as another option. Generally, these time periods are all reservoir and area specific.

The sleeve is set up with detents 144, 146 for opening and closing the sleeve. The detents in this example are set to release between about 5,000 to about 10,000 daN with maximum upper thresholds being in the order of 13,000 to 15,000 daN. When the upward force on the dogs 80 exceeds the threshold, the detent 144, 146 releases and the sleeve transfers from the open position, see FIG. 5B, 12B, to the closed position, see FIG. 6B, 12A.

When the sleeve transfers from the open to the closed position, the sleeve is dampened in reverse (see Applicant's U.S. application Ser. No. 15/013,983, entitled Tension Release Packer For A Bottom Hole Assembly, filed Feb. 2, 2016) and the shock load of the closing action is transferred to surface through indication of a coiled tubing string weight loss.

When the sleeve is closed the coiled tubing may be over pulled, for example at weight greater than 10,000 daN, at surface to confirm closure, however in most cases this is not necessary. Surface weight indication for locating the sleeve, shifting it open and shifting it closed is useful with regards to operational confidence and optimizing operations at surface.

Figure 7A:
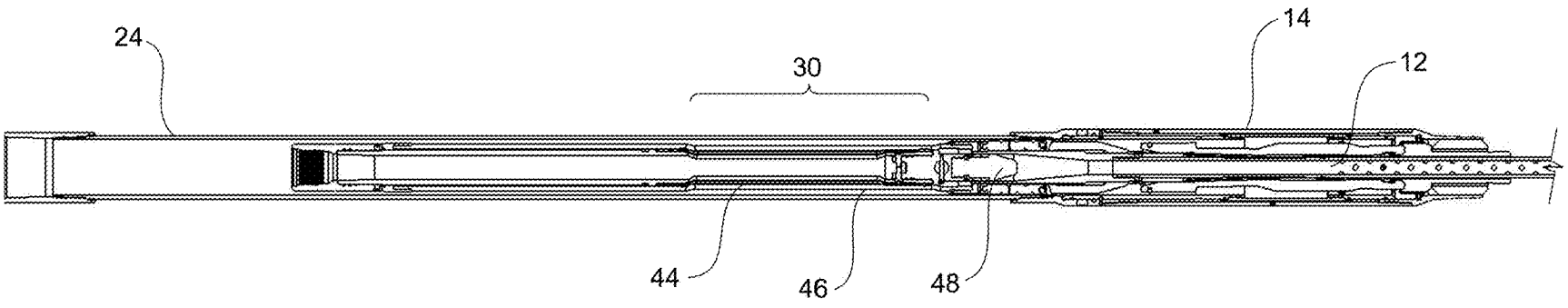
FIGS. 7A and 7B illustrate the tool being moved downhole from the sleeve after closing the sleeve according to FIGS. 6A and 6B.
Figure 7B:
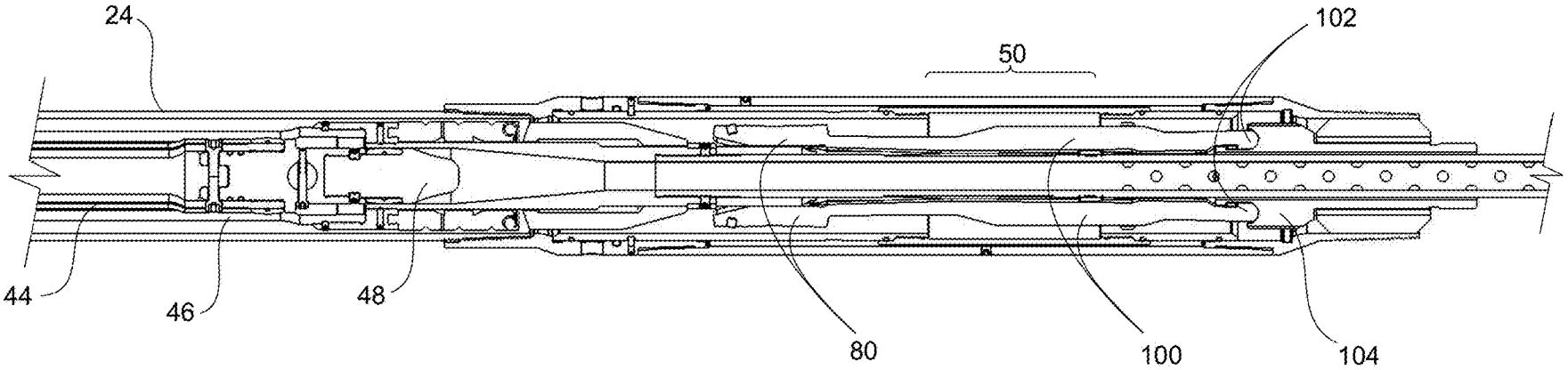

With reference to the arrangement of FIGS. 7A,7B the actuator tool is shown when releasing from a closed sleeve. Also with further reference to FIGS. 7A,7B, 17E and 18C, 20C the actuator tool is shown running downhole.

When the sleeve is closed, the well at that zone is isolated. The tool dogs are released from the sleeve by RIH with the coiled tubing shifting the J-Slot to M2. The inner activation mandrel 90 travels downhole to the dog release position in the J-Slot 92. The annular retainer ring 106 forces the dogs' arms 100 to the radially withdrawn position. The outer J-Slot housing 150 is restrained by the drag block 140 and the inner activation mandrel 90 and associated J-Pin 154 travels to the release position. Once the mandrel travel sufficiently downhole, the arm cam's 120 are forced by the retainer ring 106 to collapse the dogs 80 from the sleeve profile 50, the dogs are unlocked from the sleeve and the tool is free to travel downhole.

Figure 8A:
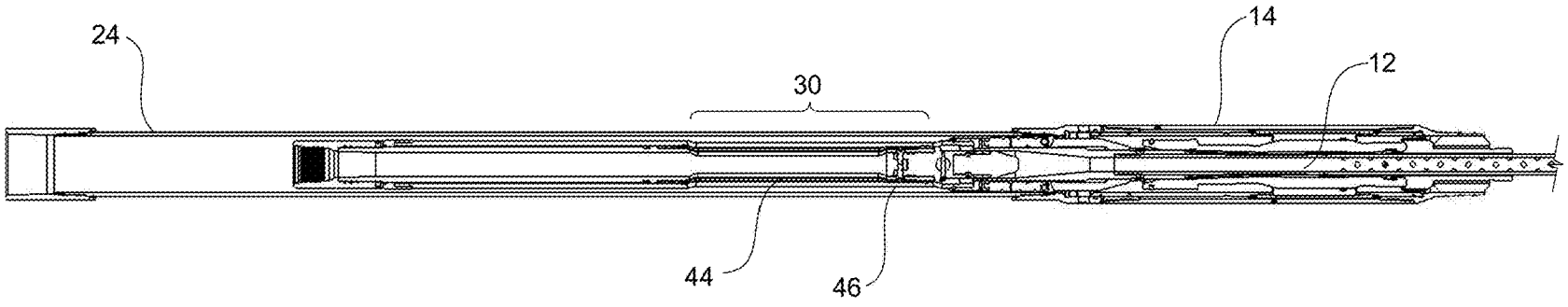
FIGS. 8A and 8B illustrate the alternate embodiment of the tool being moved downhole from the sleeve after opening the sleeve according to FIGS. 4A and 4B.
Figure 8B:
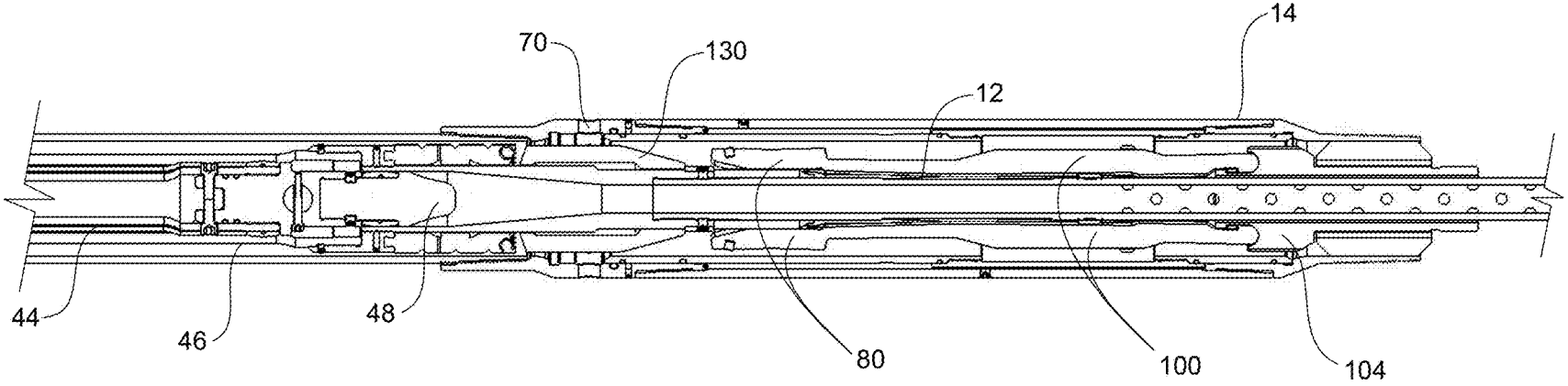

With reference to the arrangement of FIGS. 8A, 8B the actuator tool 12 is shown when releasing from an opened sleeve 20. In the previous pull step for a particular sleeve valve, to proceed without closing the sleeve valve, one avoids overpulling over about 5,000 daN to avoid overcoming the detent 144,146 and closing that sleeve 20.

Leaving the sleeve open may be done in a couple ways. The first method is when confirming the engagement with the sleeve, the string weight load plus 5,000 daN, the net weight, is not exceeded. If the detent firing load in the sleeve is not exceeded the sleeve will not shift and verification of this is indicated at surface. If the sleeve does not shift there will not be a weight loss at surface pulling up on the coiled tubing. As in closing the sleeve the tool goes through the same inner activation mandrel transition of unlocking the dogs.

After pulling the coiled tubing uphole to a load less than the about 5,000 daN over coiled tubing string load, one proceeds to travel down with the coiled tubing. The tool again transitions from dogs 80 being forced outwardly position (FIG. 6B) to forcing the dogs 80 inwardly via the retainer ring acting on the arm cam's surface 120. Once the retainer ring 106 forces the dogs 80 to the collapsed position (FIGS. 7B, 8B), the tool 12 can travel downhole.

Another method of leaving the sleeve open after the frac or stimulation treatment is to provide an alternate J-Slot sleeve profile 154 and pattern so that the sequence to optionally close the sleeve is eliminated. Rather than an uphole path to the extreme uphole position (U), the slot could terminate at the intermediate M1 position for pulling out of hole. This would allow the tool to be pulled off the sleeve without having to travel down to release the tool. The J-Slot mechanism 92 may have various configurations and sequence patterns to provide a means to change several operating parameters of the tool.

Figure 9A:
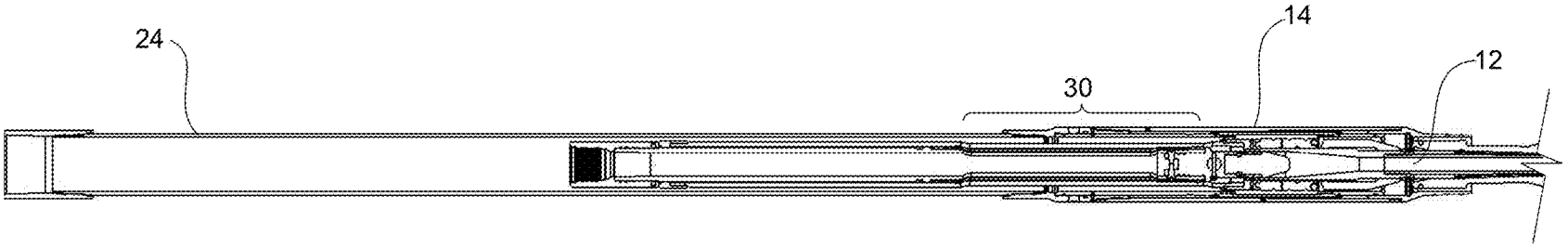
FIGS. 9A and 9B illustrate the tool released from the sleeve and running downhole to cycle the J-slot mechanism in preparation for moving to a next sleeve.
Figure 9B:
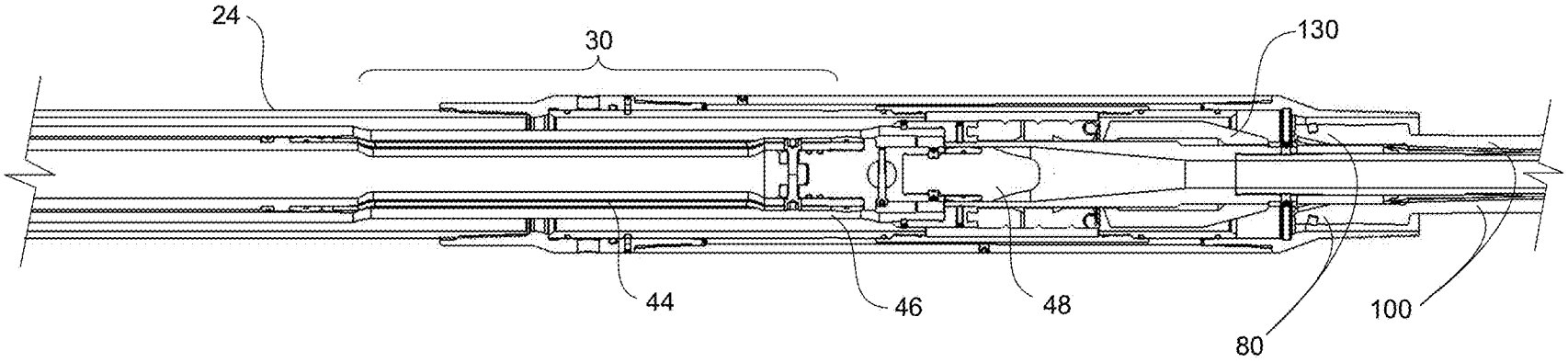
Figure 10A:
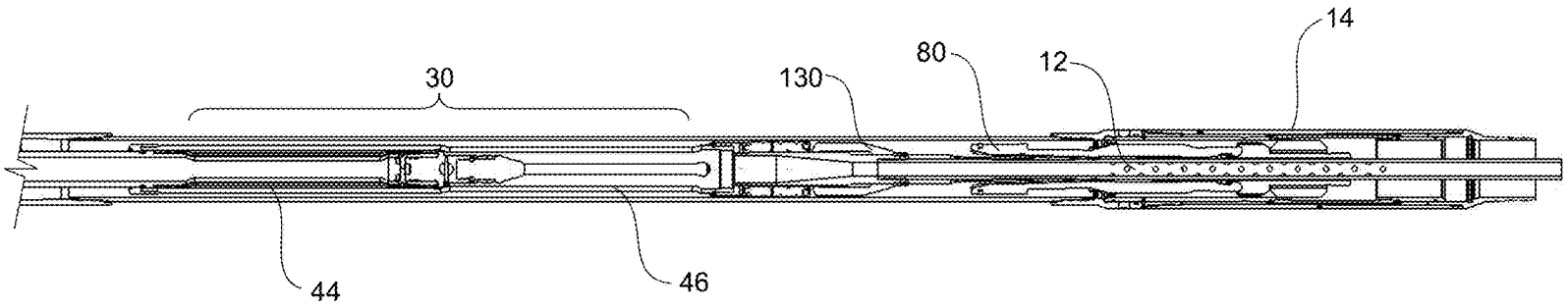
Figure 10B:
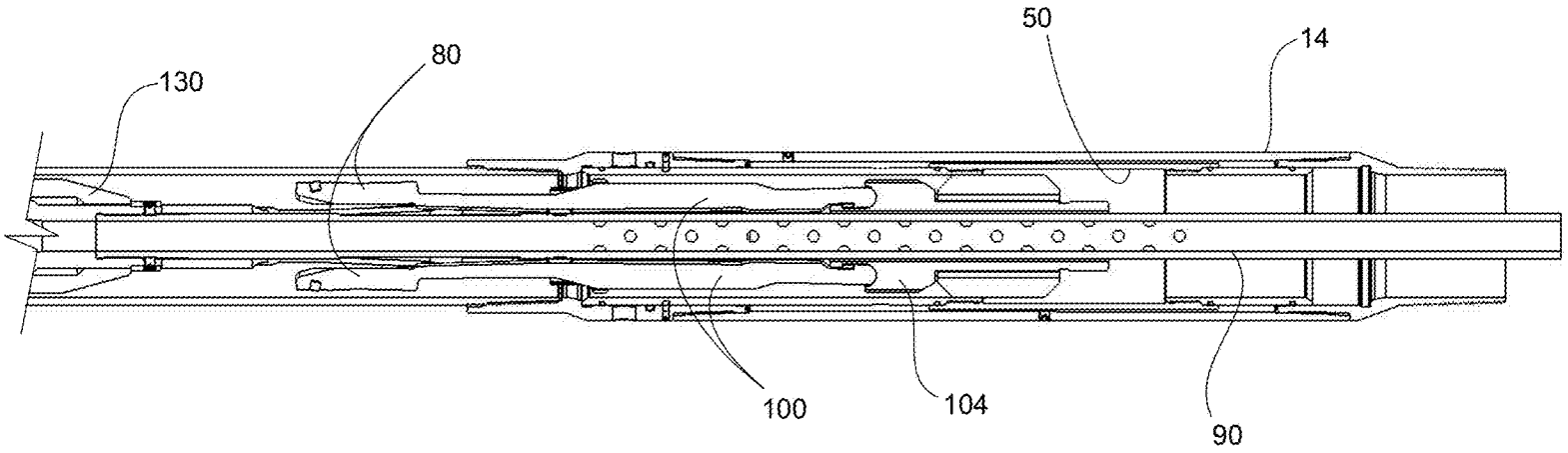

With reference to the arrangement of FIGS. 9A, 9B the tool 12 can RIH to ensure cycling of the J-Slot 92.

With reference to the arrangement of FIGS. 9A, 9B, with the tool 12 released from sleeve 20, whether leaving the sleeve open or closed, one runs in hole with the tool travelling downhole, with the dogs 80 all retracted. Running the tool strictly shifted to the RIH mode, configures the tool 12 as a slick line tool where no engagement with the sleeves or casing collars is indicated, unless the stacked beam drag block assembly 142 is set up with a backup location dog for the sleeve.

With reference to the arrangement of FIGS. 10A, 10B, FIG. 17F, and FIGS. 18C, 20D, the actuator tool 12 is shown in pull out of hole mode where the dogs 80 are retracted. After RIH to free the tool from the sleeve the coiled tubing direction is reversed to move uphole and correspondingly the activation mandrel 90 and retainer ring 106 transitions along the arm cam 120, continuing to collapsing the dogs.

In the event the retainer ring 106 fails to retract the dogs 80, as the leading angle of the dogs is set at >80 degrees, with emergency coiled tubing force, such as at or greater than about 25,000 daN, the dogs will release from the sleeve shoulder 62 and be forced to collapse, such as in the event the retainer ring 106 failed or the dogs 80 bent, buckled or failed in some other way.

With reference to FIG. 16A, in the embodiment described herein the J-Slot profile 152 sequence repeats on the sixth cycle.

Downhole—Run in with mandrel restrained no lower than an intermediate (MID-2/M2) STOP;

Uphole—pull up to full UP/U STOP position to locate the dog in the sleeve profile;

Downhole—set down to a downhole DOWN/D STOP to open the sleeve, actuate the seal, and conical wedge of cone into the dogs and permit treatment, the J-Pin may or may not reach full bottom of the slot;

Uphole—pull up to the fully UP/U STOP and either pull greater than threshold weight to release detent to close sleeve; OR pull less than threshold weight to avoid releasing detent, the sleeve remains open, but sufficient weight at surface indicates UP STOP confirmed and J-Slot transition is achieved;

Downhole—cycle down to an intermediate STOP, such as about the MID-2/M2 STOP, to avoiding arresting the contacting and triggering accidental seal actuation and dog set—resets dogs to the RIH and POOH position; and Uphole—pull up to intermediate MID-1/M1 STOP for free movement of the tool and conveyance tubing in the completion string past this sleeve and other sleeves as necessary such as re-positioning or POOH.

Instrumented Sleeves

One of the aspects of being able to close sleeves, as set forth above, is to be able to shut off stages that are affecting the well, including producing mainly water. There are various laborious techniques to determine if a zone is no longer hydrocarbon-producing, but is merely producing more water. Rather than wellbore testing that requires significant access, time and testing procedures, Applicant instead will provide instrumented sleeve.

Low-cost transducers are fit to each sleeve for determination of well parameters that are indicative of a change in flow or flow quality (direct flow sensor or through temperature, pressure, vibration. For example, software could permit analysis for converting a change in temperature can indicate an increase in flow rate and coupled with surface observations of a higher water cut, could identify that zone as the problem zone and initiate a closing of the sleeves for that zone. The information could be real time with instrumentation cabling external to the sleeved casing, or radio transmission, or other continuous transmission. Examples include fibre-optic, electric per hydraulic line external to the casing. Alternately, the sleeve's electronics package could include memory chip and battery for periodic retrieval with a tool run downhole, such as one per month.

As described in Applicant's co-pending U.S. application Ser. No. 14/405,609, filed as a national phase from WO 2013/185225, incorporated herein by reference in its entirety, data collected by a linear array of fiber optic sensors is utilized for mapping the background noise in the wellbore. The noise mapping is useful to "clean up" data which is obtained from the one or more microseismic sensors, such as 3-component geophones in a frac imaging tool (FIM), which is deployed within the same wellbore below the fracturing tool.

In embodiments, having fiber optic cables attached externally to casing cemented into the wellbore for detection of temperature and acoustic energy related to flow, the fiber optics can also be used as the linear array of fiber optic sensors. Thus, a separate array of fiber optic sensors is not required within the coiled tubing. While less suitable for detecting microseismic events within the formation, the fiber optics attached to the outside of the casing is particularly well suited for noise detection as described in the co-pending application as the fiber optics are well coupled.

The fiber optic sensors can be used with the FIM in real time or in memory for monitoring noise and frac placement and thereafter can be used to monitor flow.

The fiber optic sensor array is installed once with the casing. Sleeves are opened as taught herein and fracturing is completed. Microseismic events in the formation are monitored using a tool such as the FIM tool and noise is detected by the fiber optic sensor array for cleaning up the microseismic data and providing data regarding fracture placement. Thereafter, flow at each of the sleeves is monitored using the fiber optic sensors. Based upon the flow at each of the sleeves, intelligence can be provided to the operator such as to decide whether sleeves need to be closed for preventing undesirable production or injection at particular zones.

Figure 11C:
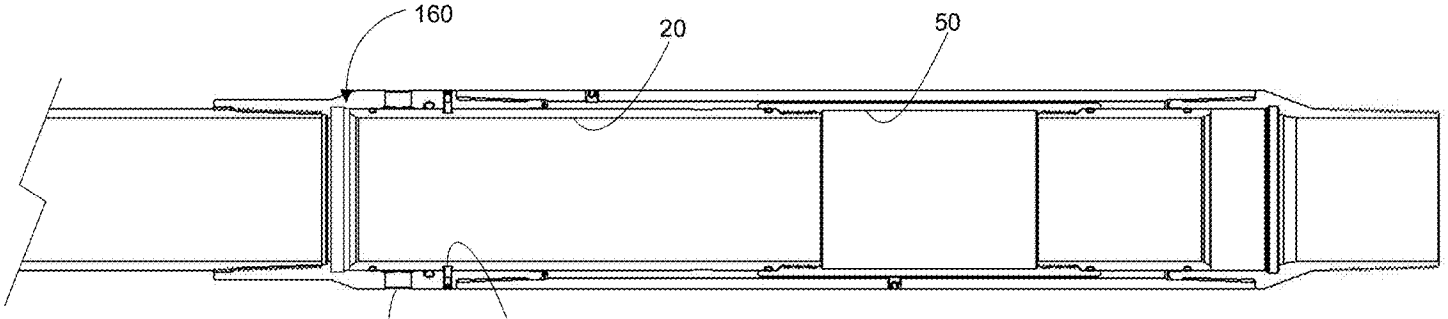
FIG. 11C illustrates an embodiment of the sleeve housing and sleeve in the closed positions having an axial uphole recess for uphole shear release.

With reference to FIG. 11C in another embodiment, the treatment tool can be used to initially release the sleeve 20 from its locked position using an uphole pull rather than force applied downhole. As shown, the sleeve is locked, such as via shear screws 138, in the sleeve housing 22 with a small axial recess 160 uphole of the sleeve 12. Accordingly, during the uphole pull to locate the sleeve 20, first the dogs engage the profile 50 and a further and pre-determined additional pull-up weight is applied to release the sleeve 20. Thereafter the operator can, with assurance, apply a mere mechanical set down weight with the conveyance tubing to shift the sleeve 20, thereby obviating the prior art need for combining setdown weight and additional fluid pumping step to apply hydraulic force to an actuated sealing member across the sleeve. After shifting mechanically to the treatment position, the zone is treated and can be closed or left open as described above.

In yet another embodiment, a jar tool [not shown] is provided above the treatment tool. The dogs of the treatment tool are engaged with the sleeve profile and conveyance tubing/coiled tubing weight is used to actuate the jar tool to release the sleeve either uphole or downhole and enable sleeve shifting. Mechanical movement of the conveyance tubing actuates the sleeve.

In yet another embodiment, each sleeve is fit to the sleeve housing with a primary hydraulic chamber filled with an incompressible fluid, such as an oil, hydraulic fluid or grease. An orifice is provided to provide and outlet for the fluid from the primary chamber. The dogs are set to the sleeve's profile and a persistent force, uphole or downhole, is applied to the sleeve to displace the fluid from the primary chamber over time to enable free axial shifting movement thereafter. In an embodiment, the hydraulic fluid moves from the primary chamber and into the sleeve bore or the wellbore annulus. In another embodiment, the fluid can move between the primary chamber to a secondary and larger chamber formed between the sleeve housing and sleeve, moving fluid from one end of the sleeve to the other.

We claim:

1. A shifting tool for sleeve valves along a wellbore, each sleeve valve having a sleeve housing having a bore fit with an axially shiftable sleeve within, the sleeve having an annular sleeve profile formed therealong, the shifting tool comprising:

a shifting housing and a drag block connected thereto and adapted for axially and frictionally restraining the shifting housing in the wellbore;

an activation mandrel axially movable relative to and axially through the shifting housing;

one or more dogs supported on one or more pivotable arms, the one or more pivotable arms and one or more dogs supported axially by the shifting housing and movable along the activation mandrel, each of the one or more dogs being radially actuable between a radially outward biased position, a sleeve profile-engaged position, and a radially inward collapsed position;

springs for biasing each of the one or more dogs radially outwardly from the activation mandrel;

a radially inward restraint operable with axial movement of the activation mandrel for restraining each of the one or more dogs in the radially inward collapsed position; and a radially outward restraint and operable with axial movement of the activation mandrel to lock each of the one of more dogs in the sleeve profile-engaged position.

2. The shifting tool of claim 1 further comprising a J-Slot mechanism having the shifting housing and a J-Pin, the J-Pin connected to the activation mandrel axially operable through the shifting housing.

3. The shifting tool of claim 1, wherein the radially inward restraint comprises a retainer movable axially together with the activation mandrel for actuating the one or more pivotable arms between the radially outward biased position and the radially inward collapsed position.

4. The shifting tool of claim 1, wherein the activation mandrel is axially movable within the shifting housing for radially actuating each of the one or more dogs between the radially outward biased position, the sleeve profile-engaged position, and the radially inward collapsed position.

5. The shifting tool of claim 1, wherein the radially outward restraint is a cone movable axially downhole with the activation mandrel to an extreme downhole position to engage and lock the one or more dogs in the sleeve profile-engaged position.

6. The shifting tool of claim 5, wherein the activation mandrel is axially movable uphole to an extreme uphole position for releasing the each of the one or more dogs to the radially outward biased position.

7. The shifting tool of claim 6, wherein the activation mandrel is axially movable to an intermediate position between the extreme uphole and extreme downhole positions for restraining each of the one or more dogs to the radially inward collapsed position.

8. The shifting tool of claim 1, wherein the activation mandrel is axially movable within the shifting housing between:

an intermediate downhole position to shift the one or more dogs to the radially inward collapsed position for running in the hole;

an extreme uphole position to shift the one or more dogs to the radially outward biased position and sleeve profile-engaged position when so located;

an extreme downhole position to open the engaged sleeve and lock the one or more dogs in the sleeve profile-engaged position for treatment; and an intermediate uphole position to shift the one or more dogs to the radially inward collapsed position for pulling out of hole.

9. The shifting tool of claim 8, wherein in the extreme downhole position the radially outward restraint locks the one or more dogs in the sleeve profile-engaged position for treatment.

10. The shifting tool of claim 9, wherein the radially outward restraint is a cone movable axially downhole with the activation mandrel for engaging the cone with the one or more dogs.

11. The shifting tool of claim 10, wherein, in the intermediate downhole position for running in the hole, the cone is dis-engaged from the one or more dogs.

* * * * *